US011095031B2

(12) United States Patent
Pfeiffer et al.

(10) Patent No.: US 11,095,031 B2
(45) Date of Patent: Aug. 17, 2021

(54) LOSSY ANTENNA ARRAYS WITH FREQUENCY-INDEPENDENT BEAMWIDTH

(71) Applicant: US Gov't represented by Secretary of the Air Force, Wright-Patterson AFB, OH (US)

(72) Inventors: Carl Pfeiffer, Beavercreek, OH (US); Thomas Steffen, Xenia, OH (US); George Kakas, Dayton, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 89 days.

(21) Appl. No.: 16/781,306

(22) Filed: Feb. 4, 2020

(65) Prior Publication Data

US 2020/0259259 A1 Aug. 13, 2020

Related U.S. Application Data

(60) Provisional application No. 62/814,083, filed on Mar. 5, 2019, provisional application No. 62/803,772, filed on Feb. 11, 2019.

(51) Int. Cl.

| | |
|---|---|
| ***H01Q 5/25*** | (2015.01) |
| ***H01Q 15/00*** | (2006.01) |
| ***H01Q 13/10*** | (2006.01) |
| ***H01Q 13/20*** | (2006.01) |
| ***H01Q 21/00*** | (2006.01) |
| ***H01Q 13/08*** | (2006.01) |
| ***H01Q 5/28*** | (2015.01) |

(52) U.S. Cl.
CPC ..... *H01Q 5/25* (2015.01); *H01Q 5/28* (2015.01); *H01Q 13/085* (2013.01); *H01Q 13/106* (2013.01); *H01Q 13/206* (2013.01); *H01Q 15/0053* (2013.01); *H01Q 21/0075* (2013.01)

(58) Field of Classification Search
CPC ..... H01Q 5/25; H01Q 5/28; H01Q 13/106; H01Q 13/206; H01Q 13/08; H01Q 13/085; H01Q 15/0053; H01Q 21/0006; H01Q 21/0075; H01Q 21/0018; H01Q 21/0031; H01Q 21/06; H01Q 21/061; H01Q 21/064; H01Q 21/067
See application file for complete search history.

(56) References Cited

U.S. PATENT DOCUMENTS

| | | | | |
|---|---|---|---|---|
| 6,317,094 | B1 * | 11/2001 | Wu | H01Q 13/085 343/767 |
| 2018/0198215 | A1 * | 7/2018 | Mandeville | H01Q 21/0087 |
| 2020/0161774 | A1 * | 5/2020 | Carlson | H01Q 13/085 |

* cited by examiner

*Primary Examiner* — Robert Karacsony
(74) *Attorney, Agent, or Firm* — AFMCLO/JAZ; David E. Franklin

(57) ABSTRACT

An ultra wide band (UWB) antenna includes: (i) an array of antenna elements spaced from a central axis; and (ii) a network of lossy feedlines respectively communicatively coupled to the array of antenna elements. Each lossy feedline is periodically loaded with a resistance that is capacitively coupled to ground. Respective lengths of each lossy feedlines are selected to increase with an increase in distance from the central axis to achieve frequency independence of a radiated beamwidth from the UWB antenna.

5 Claims, 22 Drawing Sheets

900

LOSSY ANTENNA ARRAYS WITH FREQUENCY-INDEPENDENT BEAMWIDTH

CROSS-REFERENCE TO RELATED APPLICATIONS

This application claims the benefit of priority under 35 U.S.C. § 119(e) to: (i) U.S. Provisional Application Ser. No. 62/803,772 entitled "Lossy Antenna Arrays with Frequency-Independent Beamwidth," filed 11 Feb. 2019; and (ii) U.S. Provisional Application Ser. No. 62/814,083 entitled "Uniform Beamwidth UWB Feed Antennas Using Lossy Transmission Lines" filed 5 Mar. 2019, the contents of both of which are incorporated herein by reference in their entirety.

ORIGIN OF THE INVENTION

The invention described herein was made by employees of the United States Government and may be manufactured and used by or for the Government of the United States of America for governmental purposes without the payment of any royalties thereon or therefore.

BACKGROUND

There are many quasi-optical microwave systems that require antennas that radiate frequency-independent patterns. In contrast, the vast majority of antennas have a beam that becomes narrower as the frequency is increased. Some frequency-independent antennas have been reported previously, but they almost all have directivities of 10 dB or below. There is no simple method that allows for customization of their radiation patterns to other directivities. Active electronically scanned array (AESA) uses active circuitry and is an order of magnitude more expensive than antennas fabricated using standard printed circuit board (PCB) techniques.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1A:
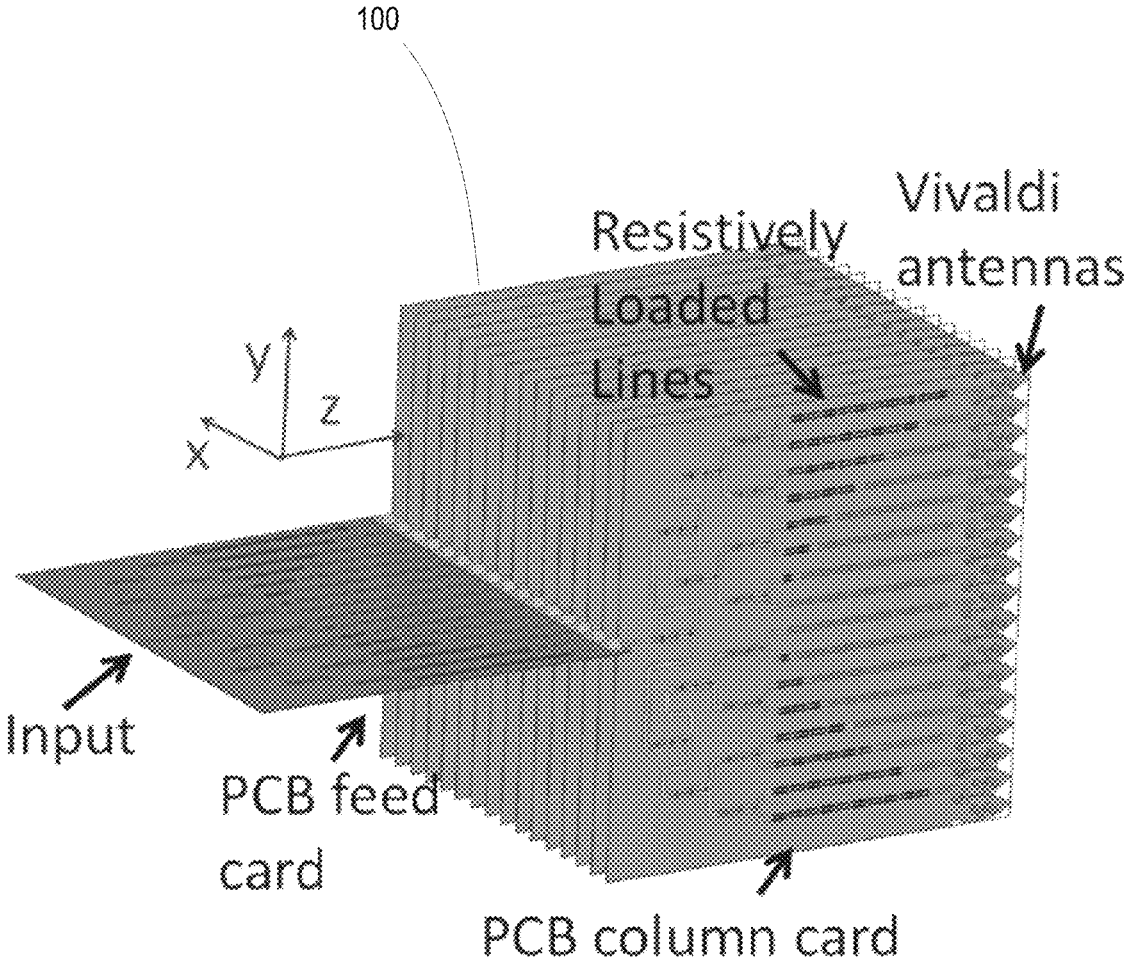
FIG. 1A is a three-dimensional view of an ultra wide band (UWB) Vivaldi antenna array fed with a lossy transmission line network for realizing uniform beamwidth versus frequency, according to one or more embodiments.

According to aspects of the present disclosure, an ultra wide band (UWB) antenna includes: (i) an array of antenna elements spaced from a central axis; and (ii) a network of lossy feedlines respectively communicatively coupled to the array of antenna elements. Each lossy feedline is periodically loaded with a resistance that is capacitively coupled to ground. Respective lengths of each lossy feedlines are selected to increase with an increase in distance from the central axis to achieve frequency independence of a radiated beamwidth from the UWB antenna.

The ideal ultra-wideband (UWB) antenna feed for lens and reflector systems radiates a uniform and customizable beamwidth vs. frequency. Here, a new antenna concept for radiating frequency-independent Gaussian beams with arbitrary bandwidths and beamwidths is reported. It is analytically shown how to resistively load a transmission line network to maintain Gaussian amplitude taper across an antenna array aperture. In contrast to many other feed antennas, the radiation properties here can be tailored without time-consuming full wave optimizations. The radiated beamwidth, bandwidth, antenna size, radiation efficiency, and gain can all be quickly estimated using the derived closed-form expressions. An example, 16×16 Vivaldi element array is fed with a network of resistively loaded microstrip lines. The simulated designed array radiates a Gaussian beam with 10 dB full beamwidth of 35°±5° and directivity of 20 dB±1.5 dB over 6.5 GHz-19 GHz (3:1 bandwidth ratio). However, the radiation efficiency is inherently low due to the large loss associated with generating the Gaussian amplitude taper. The example array has a simulated radiation efficiency of 1% at the higher operating frequencies. The array was fabricated and measured. The measured beamwidths agree well with simulation to validate of the reported theory. This architecture is a particularly attractive option for feed antennas that require customizable directivities, and can tolerate low radiation efficiencies such as test and measurement.

Introduction: Test and measurement systems often use lenses and reflectors to shape electromagnetic fields (e.g., compact reflector antenna measurements, free space material measurements, free space S-parameter measurements). These systems commonly employ corrugated horns as sources since they radiate a Gaussian beam with high mode purity [1]. This allows system engineers to use simple quasi-optical formulas to design the location, focal lengths, and diameters of various quasi-optical components [2]. However, these horns only operate over the waveguide bandwidth (less than one octave). Ultra-wideband measurements therefore require swapping feed horns across the different bands. Alignment and calibration steps need to be performed every time the feed horn is replaced, which is time consuming and expensive. This motivates the use of UWB feed antennas. The ideal feed maintains a constant radiation pattern vs. frequency. However, it can be challenging to realize such an antenna since the vast majority of directive antennas have a beamwidth that reduces with frequency due to the increased electrical size of the aperture.

Antennas radiating frequency-independent radiation patterns have previously been reported. Flared horn antennas have been optimized to realize stable patterns over multi-octave bandwidths [3, 4]. However, they require extensive design optimization and are quite bulky. Furthermore, they can have relatively high peak cross-pol levels of −10 dB [4]. The dual stacked log-periodic antenna uses a 2 element array of log periodic antennas to improve the H-plane directivity over that of a single log-periodic antenna. These antennas maintain a near-constant directivity of ~10 dB over a decade bandwidth. A similar concept is employed in the Eleven antenna [5], which also realizes a constant beamwidth over a decade, good impedance match, and high radiation efficiency. However, extensive optimization is required to properly tune the antenna dimensions. In addition, the peak cross-polarized radiation is only −10 dB down in some cases [6]. Sinuous antennas have also been designed to have a similar performance [7]. It is unclear how to modify the design of these log-periodic based antennas for applications requiring directivities higher than ~10 dB. An UWB design with substantially higher directivity was reported in [8]. This antenna employs a leaky wave slot between two different dielectrics to realize frequency independent radiation at mm-wave frequencies. However, there is asymmetry between the E and H planes, as well as high sidelobe levels. The highest performance option is to utilize an active electronically scanned phased array (AESA) since every element has a phase shifter and attenuator that can be calibrated across all operating frequencies [9]. Thus, AESAs can realize optimal radiation patterns over ultra-wide operational bandwidths. However, they are complicated and expensive.

Here, a new concept for an UWB, passive antenna array is reported that realizes a near-constant directivity over a bandwidth of 6.5 to 19 GHz. The array is fed with a network of lossy transmission lines whose insertion loss increases with frequency to compensate for the increased electrical size of the aperture at higher frequencies. A systematic design process is reported which allows the array to be easily scaled for nearly arbitrary radiated beamwidths. The simple design procedure comes at the cost of low radiation efficiency at high frequencies though. Therefore, it is envisioned this antenna is particularly useful for UWB test and measurement applications where lower signal strengths can be better tolerated. Simulations show good agreement with theory. A 16×16 element Vivaldi antenna array is designed with a simulated 10 dB full beamwidth of 35°±5° over the operating band. The array is fabricated and measured. The measured beamwidths agree well with calculations. However, the measured radiation patterns do have large sidelobes due to unexpected radiation from the microstrip feed network. A method to eliminate this unwanted radiation in future antennas is discussed.

Ideal Gaussian Beam Source: Gaussian beams are commonly utilized in quasi-optical systems since they can be easily controlled with high precision using lenses and mirrors. At the location of beam waist (z=0), an ideal Gaussian beam has an electric field profile (E(r,λ)) given by, $$E(r, \lambda) = e^{-\frac{r^2}{w_0^2(\lambda)}} \tag{1}$$

where $r=\sqrt{x^2+y^2}$ is the radial distance from the beam axis, $w_0$ is the beam waist radius, and λ is the free space wavelength. The normalized far field radiated by the beam ($E_{ff}(\theta,\lambda)$) is given by the Fourier Transform of the field profile, $$E_{ff}(\theta, \lambda) = \int\int E(r, \lambda)e^{j(\frac{2\pi}{\lambda})\sin(\theta)(x+y)}dxdy = e^{-\left(\frac{\sin(\theta)\pi w_0(\lambda)}{\lambda}\right)^2} \tag{2}$$

Where θ is the angle from the beam axis. Therefore, the beam waist radius must be directly proportional to the wavelength for realizing a frequency independent far field. Combining (1) and (2) gives the ideal field profile at the aperture of the antenna for realizing a Gaussian beam with constant beamwidth vs frequency, $$E(r, \lambda) = e^{-\left(\frac{r\pi\sin(\theta_0/2)}{\lambda}\right)^2} \tag{3}$$

where $\theta_0$ is the full beamwidth at which the power drops to $1/e^2$ (8.7 dB).

Figure 1B:
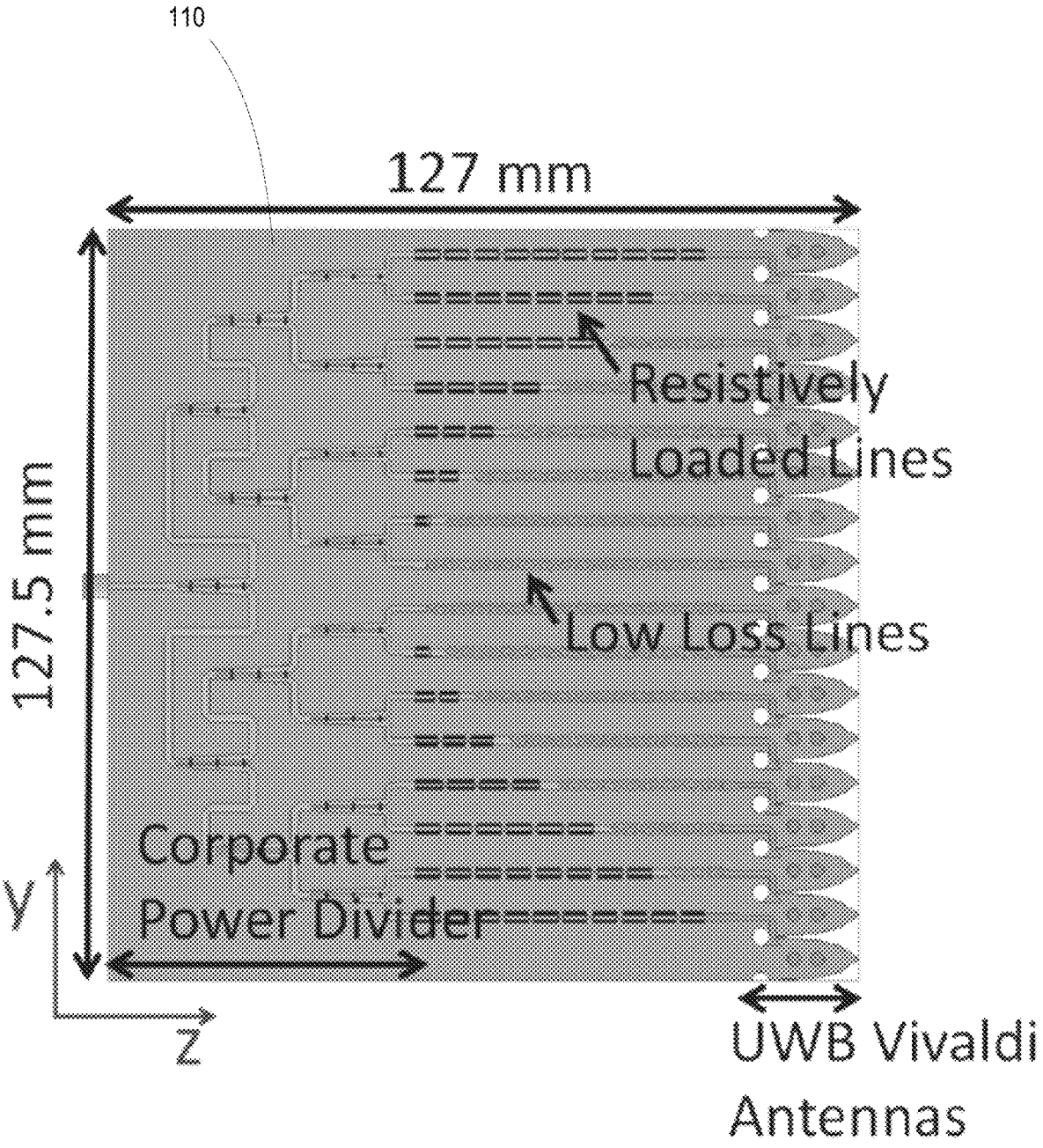
FIG. 1B is a top view of a printed circuit board (PCB) column card of the UWB Vivaldi antenna array of FIG. 1A, according to one or more embodiments.

FIG. 1A depicts an ultra wide band (UWB) Vivaldi antenna array 100 fed with a lossy transmission line network for realizing uniform beamwidth versus frequency. FIG. 1B depicts a printed circuit board (PCB) column card 110 of the UWB Vivaldi antenna 100 (FIG. 1A). Consider an antenna array fed with an ideal UWB corporate power divider as shown in FIG. 1A. The corporate power divider is assumed to be lossless for now. Lossy transmission lines that function as frequency dependent attenuators connect the power divider outputs to the radiating elements.

From (3), we can immediately draw some conclusions on the performance limitations using this resistive taper approach. First, the Gaussian beam mode purity is analyzed. Since an ideal Gaussian amplitude distribution extends to infinity, it must be truncated at some point. The Gaussian beam coupling coefficient ($e_{rad}$) quantifies the mode purity and is defined as the inner product of the field at the aperture and that of an ideal Gaussian beam [2]. It is straightforward to show that the coupling coefficient is equal to, $$e_{coup}(r_{ap}, \lambda) = 1 - e^{-2\left(\frac{r_{ap}\pi\sin(\theta_0/2)}{\lambda}\right)^2} \tag{4}$$

Where $r_{ap}$ is the antenna aperture's radius. Since the antenna employs attenuation to realize the Gaussian amplitude taper, the radiation efficiency ($e_{rad}$) is another important performance metric. Taking the ratio of the power available from the corporate power divider to the total power at the aperture gives the radiation efficiency, $$e_{rad}(r_{ap}, \lambda) = 1\frac{\lambda^2 e_{coup}}{2r_{ap}^2\pi^2\sin^2(\theta_0/2)} \tag{5}$$

For a given operating wavelength, a larger antenna aperture radius ($r_{ap}$) leads to a higher Gaussian mode purity ($e_{coup}$), but a lower radiation efficiency ($e_{rad}$). Let us define the maximal operating wavelength ($\lambda_{max}$) to be such that the beam waist radius is equal to the antenna radius. In this case, the aperture size is related to the beamwidth by $$r_{ap}=\lambda_{max}/(\pi\sin(\theta_0/2)) \tag{6}$$

In this case, the coupling coefficient and radiation efficiency are 86% and 43%, respectively, at the largest operating wavelength. The wavelength dependence on the radiation efficiency (5) simplifies to, $$e_{rad}(r_{ap}, \lambda) = \frac{1}{2}\left(\frac{\lambda}{\lambda_{\max}}\right)^2\left(1 - e^{-2\left(\frac{\lambda_{max}}{\lambda}\right)^2}\right) = \frac{1}{2}\left(\frac{\lambda}{\lambda_{max}}\right)^2 e_{coup} \tag{7}$$

Eq. (7) illustrates there is a clear tradeoff between bandwidth and radiation efficiency. For example, the radiation efficiency at the highest operating frequency must be less than 0.5% for an antenna with a 10:1 bandwidth ratio. Note that the coupling efficiency is very near 100% at the highest operating frequencies for wideband antennas, in accordance with (4).

Figure 2A:
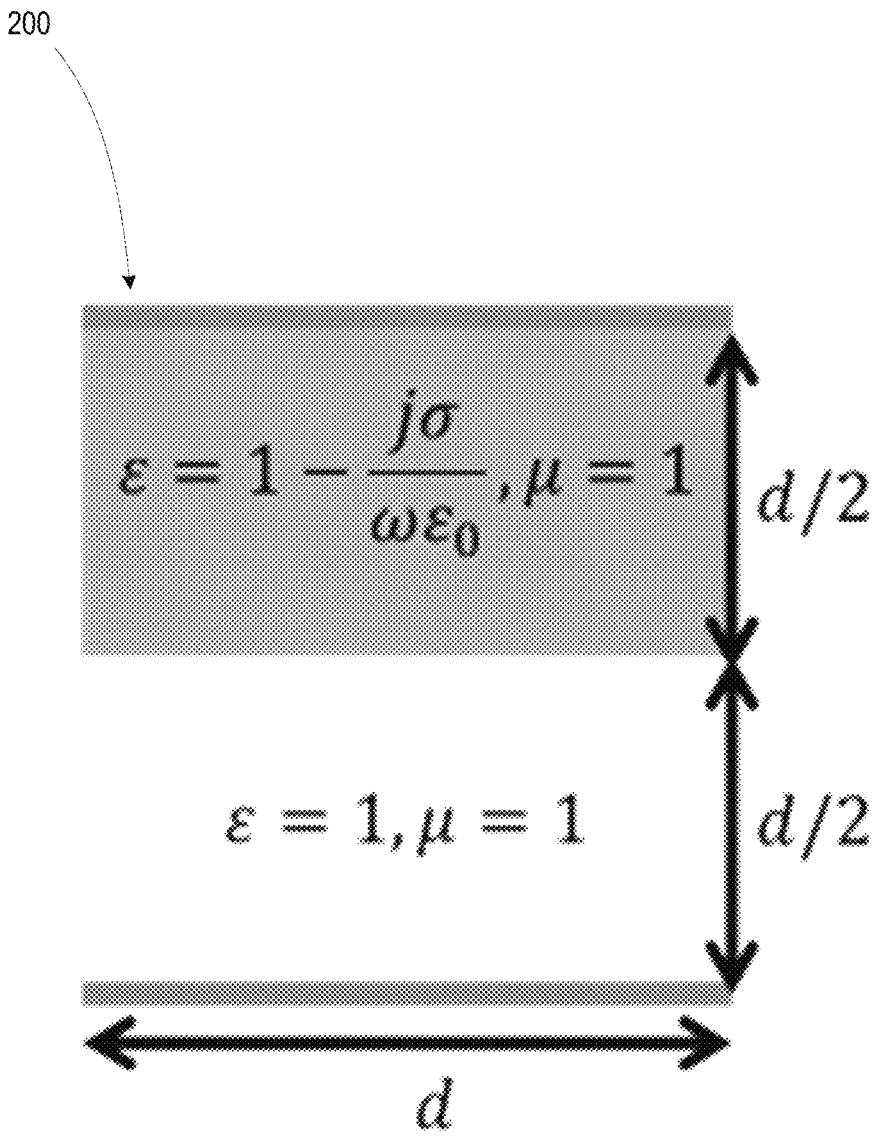
FIG. 2A is a circuit diagram of a parallel plate waveguide loaded with a lossy dielectric, according to one or more embodiments.
Figure 2B:
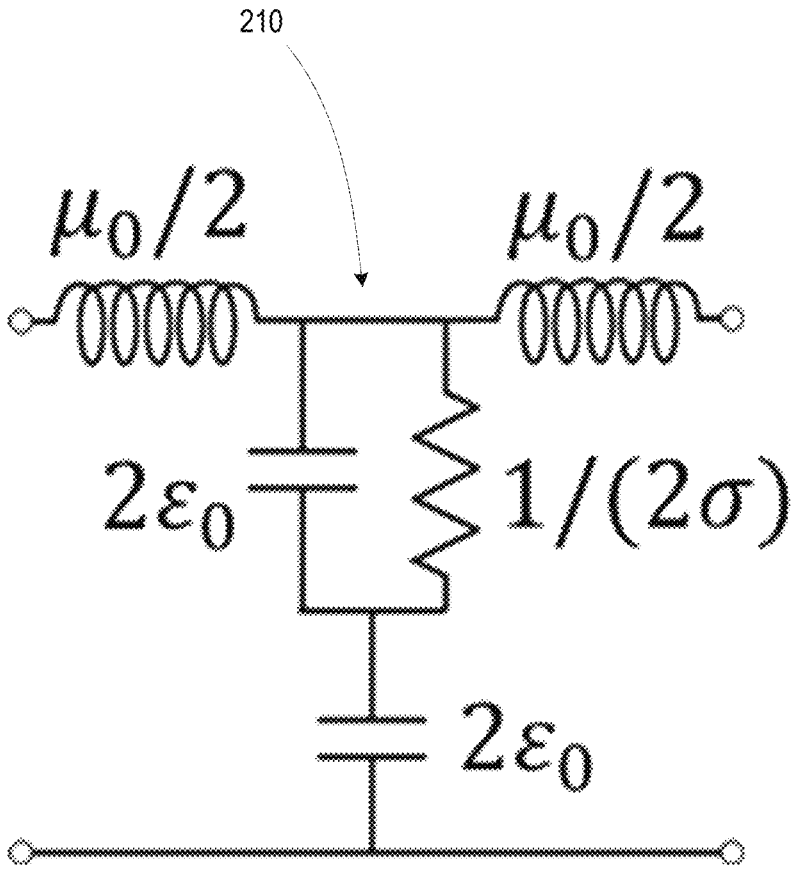
FIG. 2B is a circuit model for the parallel plate transmission line, according to one or more embodiments.

Next, a physical implementation of this lossy transmission line network is discussed. FIG. 2A depicts a circuit diagram 200 of a parallel plate waveguide loaded with a lossy dielectric. FIG. 2B is a circuit model 210 for the parallel plate transmission line. The lossy parallel plate transmission line shown in FIG. 2A consists of a stackup of air, and a lossy dielectric characterized by conductivity $\sigma$. Assuming the parallel plate thickness is much less than the wavelength in all materials, the quasi-TEM transmission line mode can be modeled with the equivalent circuit shown in FIG. 2B. The line has an effective permittivity given by, $$\varepsilon_{eff} = 2\frac{(1 - j\sigma/(\omega\varepsilon_0))}{(2 - j\sigma/(\omega\varepsilon_0))} \tag{8}$$

Furthermore, assuming the lossy material acts as a good conductor ($\sigma(\omega\varepsilon_0)>>1$), the effective refractive index simplifies to, $$n_{eff}=\sqrt{\varepsilon_{eff}}=\sqrt{2}(1-j\omega\varepsilon_0/(2\sigma)) \tag{9}$$

and the field along the transmission line behaves as, $$(z, \lambda) = \exp(-jz\omega n_{eff}/c) = \exp\left(\frac{-jz\omega}{c}\sqrt{2}\right)\exp\left(\frac{-z2\sqrt{2}\pi^2\varepsilon_0 c}{\lambda^2\sigma}\right) \tag{10}$$

where exp denotes exponential and $c=1/\sqrt{\varepsilon_0\mu_0}$ is the speed of light in free space. Note that the assumption of a good conductor ($\sigma/(\omega\varepsilon_0)>>1$) is identical to assuming the lines have a low insertion loss per wavelength. Comparing (3) with (10), the resistively loaded transmission line can realize the necessary amplitude taper for generating the desired far field, provided the transmission line lengths ($l_{lossy}(r)$) satisfy, $$l_{lossy}(r) = \frac{r^2\sigma\lambda_{max}^2}{2\sqrt{2}\pi^2 r_{ap}^2 c\varepsilon_0} = \frac{r^2\lambda_{max}^2}{\sqrt{2}\pi r_{ap}^2\lambda}\left(\frac{\sigma}{\omega\varepsilon_0}\right) \tag{11}$$

The required length each transmission line feed is a function of the radial distance from the beam axis (r), material loss ($\sigma$), and maximum operating wavelength ($\lambda_{max}$). Since $l_{lossy}$ is not a function of frequency, it is possible to design an aperture with arbitrary bandwidth ratio that radiates a pure Gaussian beam at all frequencies. However, there exists some practical limitations. Long transmission lines are required for wide bandwidths ($\lambda_{max}/\lambda_{min}>>1$). For example, an array with a 10:1 bandwidth ratio employing a high conductivity material ($\sigma/(\omega\varepsilon_0)>10$) requires transmission lines that are $100\lambda_{max}/(\sqrt{2}\pi)=22\lambda_{max}$. In practice, the requirement of high $\sigma$ (i.e., low insertion loss/wavelength) can be relaxed somewhat to reduce the required antenna size without significantly sacrificing performance.

The required length each transmission line feed is a function of the radial distance from the beam axis (r), material loss ($\sigma$), and maximum operating wavelength ($\lambda_{max}$). Since $l_{lossy}$ is not a function of frequency, it is possible to design an aperture with arbitrary bandwidth ratio that radiates a pure Gaussian beam at all frequencies. However, there exists some practical limitations. Long transmission lines are required for wide bandwidths ($\lambda_{max}/\lambda_{min}>>1$). For example, an array with a 10:1 bandwidth ratio employing a high conductivity material ($\sigma/(\omega\varepsilon_0)>10$)

requires transmission lines that are $100\lambda_{max}/(\sqrt{2}\,\pi)=22\lambda_{max}$. In practice, the requirement of high a (i.e., low insertion loss/wavelength) can be relaxed somewhat to reduce the required antenna size without significantly sacrificing performance.

It is also important to note that the lossy transmission lines have an elevated real part of the refractive index (i.e. phase delay) compared to free space (see (9)). Here, the real part of the refractive index is $\sqrt{2}$ when the lossy material thickness and the free space thickness are identical, as shown in FIG. 2A. This fact is important since the transmission line network feeding the array will consist of a combination of high-loss and low-loss line segments to realize a Gaussian amplitude taper with uniform phase. It is important that the low-loss transmission lines are engineered to have an identical phase velocity as the high loss segment to ensure every line is phase matched.

Figure 3A:
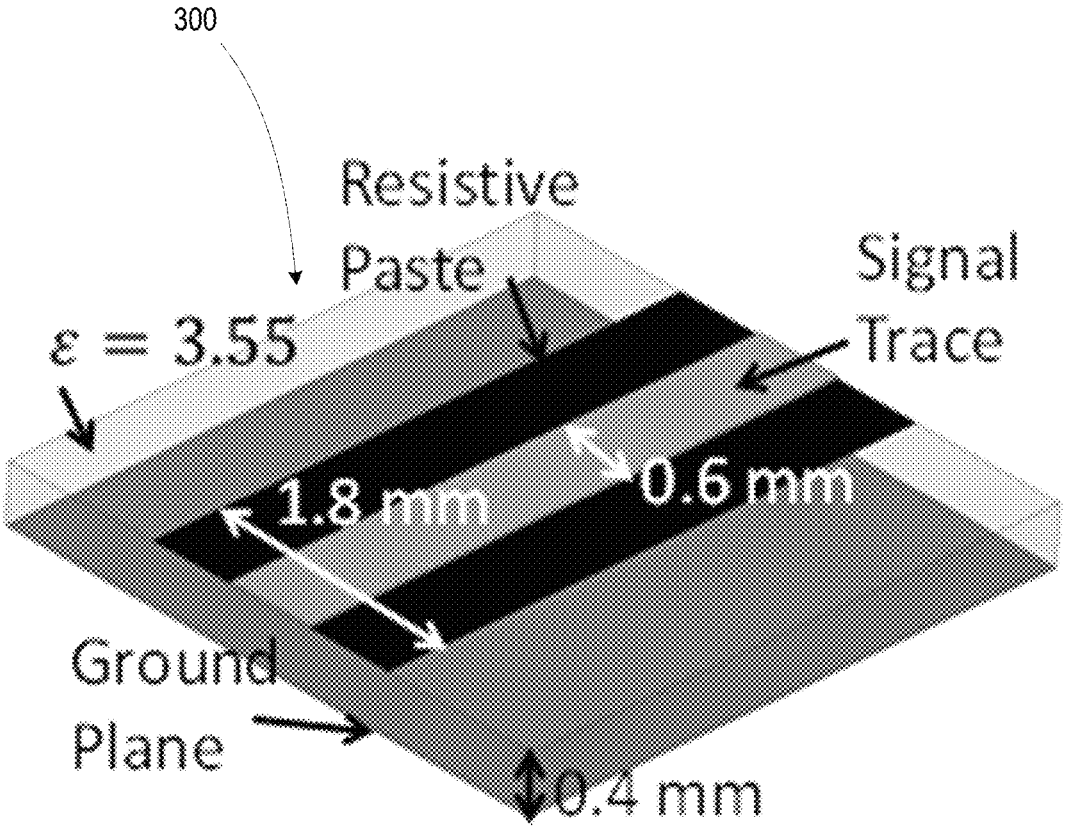
FIG. 3A is a three-dimensional view of a lossy microstrip line loaded with 100 Ω/sq resistive paste, according to one or more embodiments.
Figure 3B:
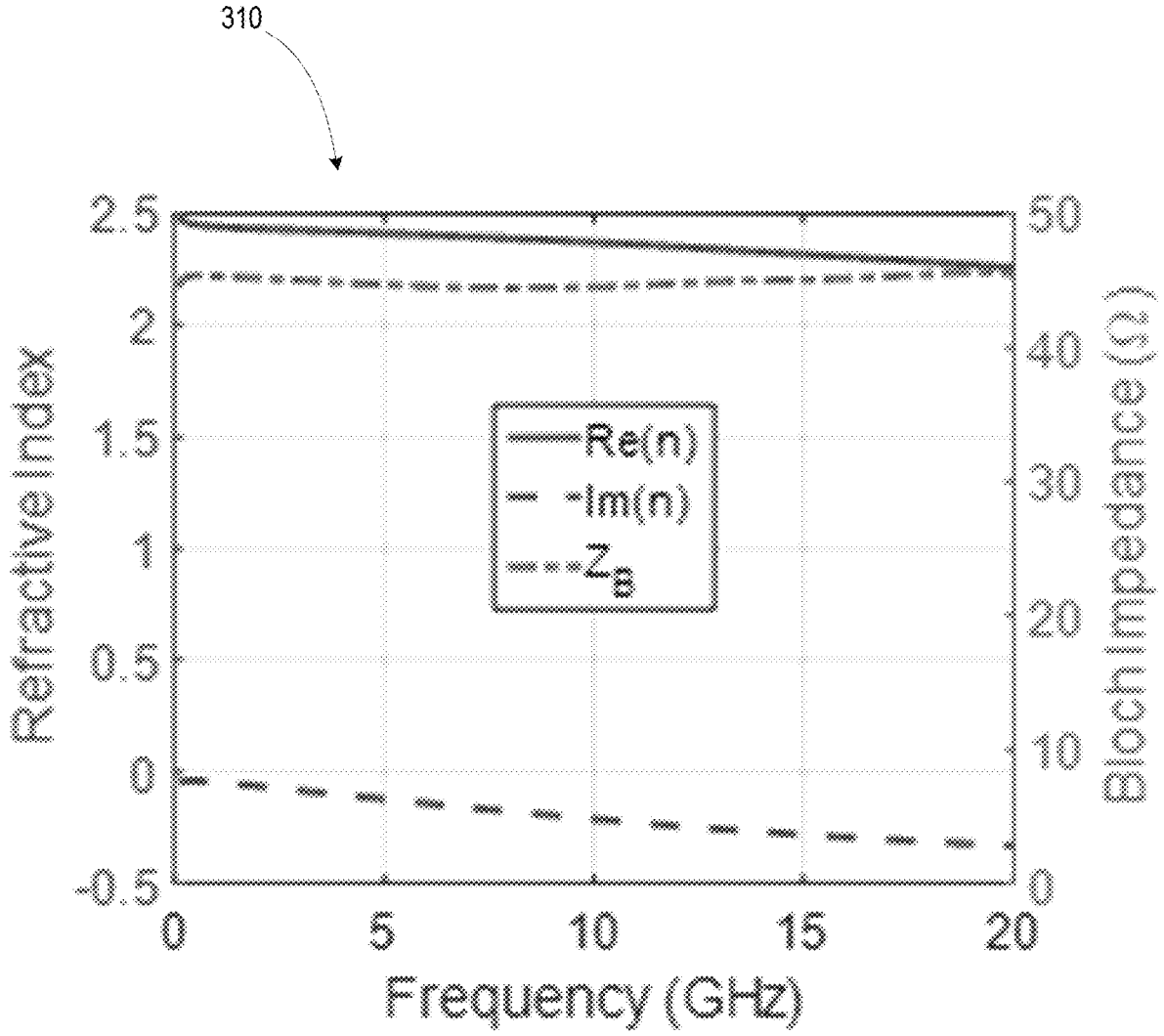
FIG. 3B is a graphical plot of refractive index and Bloch impedance of the lossy microstrip line of FIG. 3A, according to one or more embodiments.

DESIGN AND SIMULATION: Lossy Transmission Lines—A prototype antenna is designed. The lossy parallel plate waveguide discussed in the previous section provides a simple and intuitive analytic model for modelling the array. However, the parallel plate transmission line is not the most practical line from a fabrication standpoint. Any transmission line with an equivalent circuit shown in FIG. 2B will have a similar performance. FIG. 3A depicts a lossy microstrip line 300 loaded with 100Ω)/sq resistive paste. FIG. 3B depicts a graphical plot 310 of refractive index and Bloch impedance of the lossy microstrip line 300 of FIG. 3A. Lossy microstrip lines are used here with dimensions given in FIG. 3A. Microstrip lines are chosen because they can be fabricated using low-cost printed-circuitboard (PCB) techniques. In addition, integrating resistive loading is straightforward using screen printed carbon ink. An important feature of the parallel plate waveguide circuit model (see FIG. 2B) is the resistance in series with the capacitance to ground. This series resistance is implemented here using a 100 Ω/sq carbon loaded resistive ink patterned on the copper signal traces. Current flows from the signal trace, through the resistive ink, and through a capacitance to ground.

The Bloch impedance and refractive index of the lossy transmission line is shown in FIG. 3A. They are calculated using S-parameters of the transmission line from ANSYS HFSS [10]. The lines have a 45 ohm impedance, $Re(n_{eff})=2.4$, and $Im(n_{eff})$ that decreases nearly linearly from 0 to −0.35 as the frequency varies from 0 to 20 GHz. The imaginary part of the index is then combined with (9) to calculate an effective material conductivity $\sigma_{eff}=2.3$ S/m so that the parallel plate waveguide design rules can be applied here. This effective conductivity is inserted into (11) to calculate the required lengths of the lossy transmission lines as a function of position in the array, where the minimum operating frequency is 6.5 GHz. Note that there is some unwanted line dispersion since $Re(n_{eff})$ decreases from 2.4 to 2.2 when the frequency changes from 1 GHz to 19 GHz. This negative dispersion is due to the fact that the attenuation constant is quite high to reduce the required line lengths $(\sigma/\omega\varepsilon_0)>2.2$). It can be inferred from (11) that the design is robust to variance in the resistive ink properties, which can be challenging to precisely control in practice. For fixed geometrical parameters, the resistivity of the ink is proportional to the radiated beamwidth squared ($\sin^2(\theta_0/2)$). For example, if the paste resistivity increases by 20% due to fabrication tolerances, the beam shape is unchanged and the beamwidth increases by only 10%.

Figure 4A:
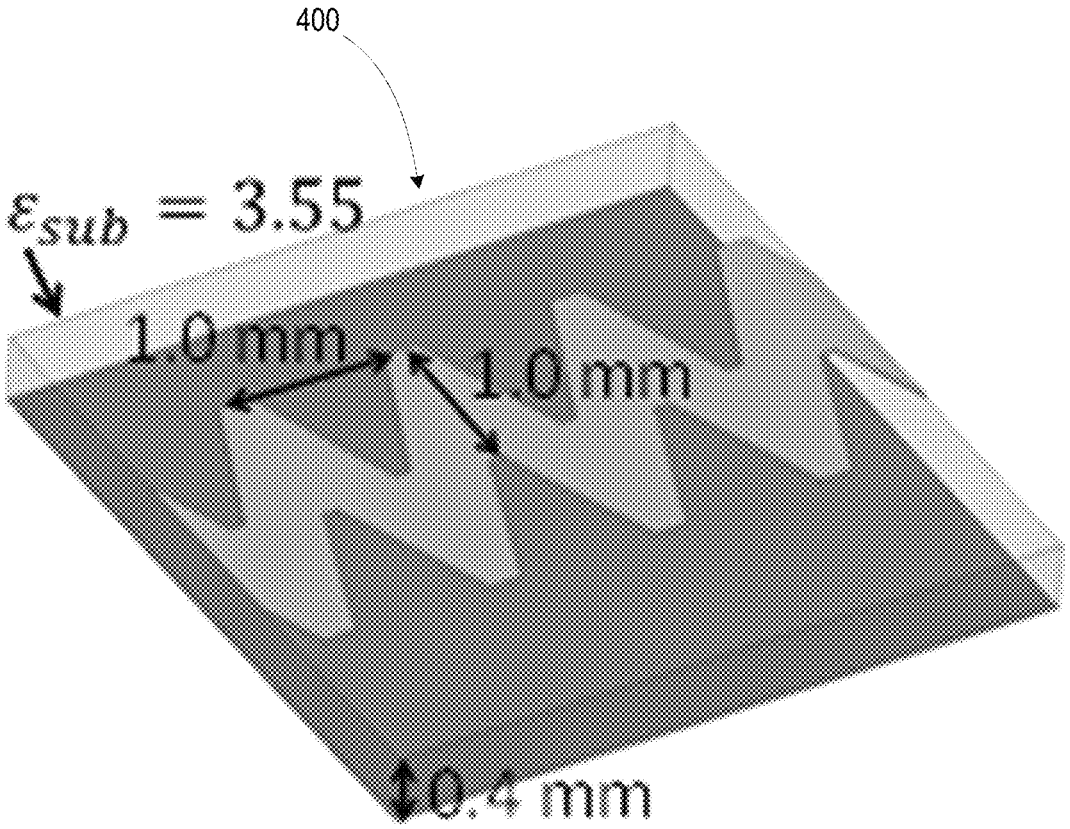
FIG. 4A is a three-dimensional view of a meandered microstrip line with refractive index equal to that of the lossy transmission lines, according to one or more embodiments.
Figure 4B:
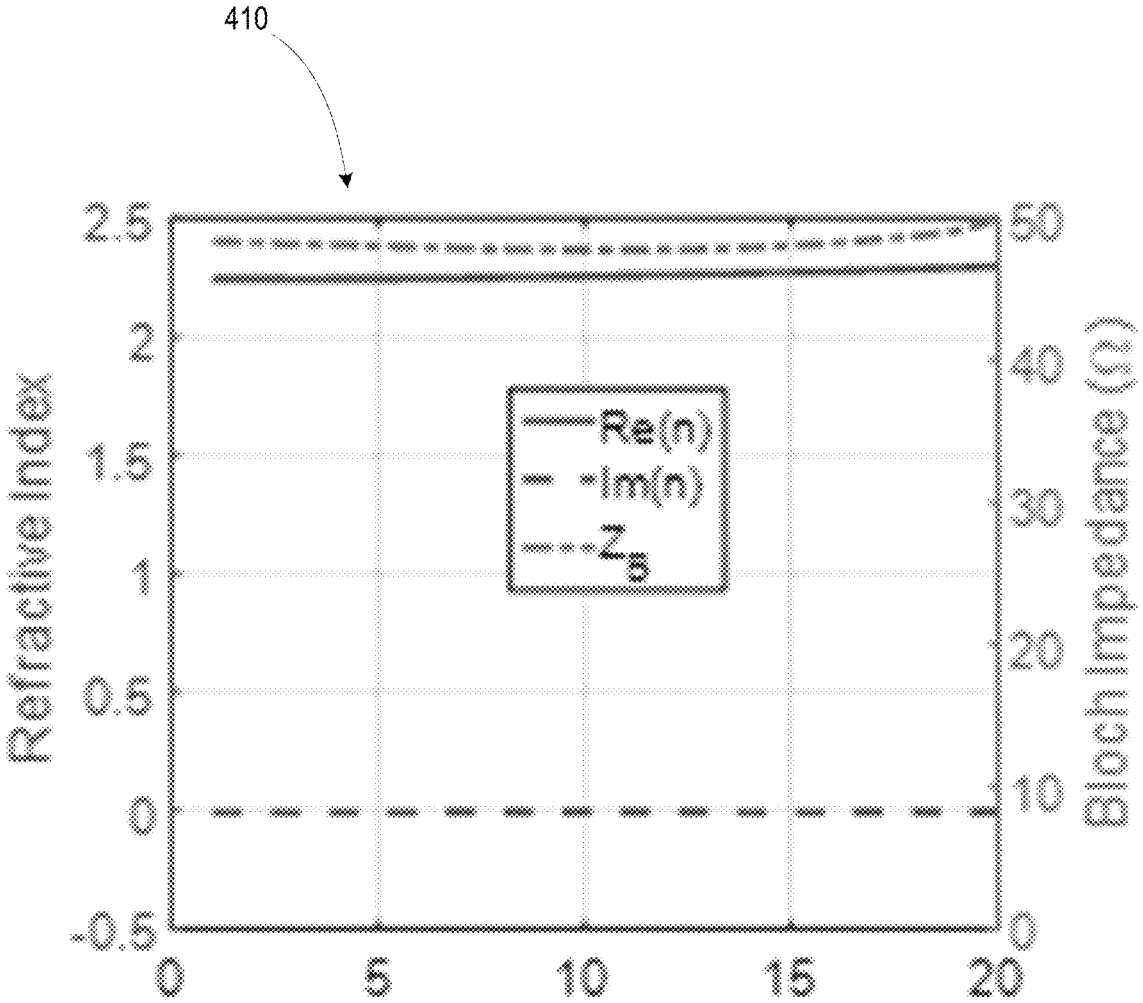
FIG. 4B is graphical plot of refractive index and Bloch impedance of the low-loss microstrip line of FIG. 4A, according to one or more embodiments.

Phase Matching with Low-Loss Transmission Lines—The field at the array aperture should have a uniform phase. Since the lossy transmission lines have variable lengths, low loss lines need to be added to realize a planar aperture with uniform phase. The low-loss lines require an identical $Re(n_{eff})$ as the lossy lines. However, it was shown earlier that resistive loading necessarily increases the effective index over that of the substrate. The effective permittivity ($\varepsilon_{ff}=n_{eff}^2$) of the lossy transmission lines is 5.8, which is 1.6 times larger than the substrate permittivity ($E_{sub}=3.55$). Therefore, the low-loss sections are meandered to increase their phase delay per unit length to be identical to that of the lossy lines. FIG. 4A depicts a meandered microstrip line 400 with refractive index equal to that of the lossy transmission lines. FIG. 4B depicts graphical plot 410 of refractive index and Bloch impedance of the low-loss microstrip line 400 of FIG. 4A. The dimensions of the low loss line are shown in FIG. 4A. The refractive index and block impedance are shown in FIG. 4B. The block impedance and $Re(n_{eff})$ are very similar to that of the lossy transmission line, which suggests there is a good impedance and phase match.

Figure 5A:
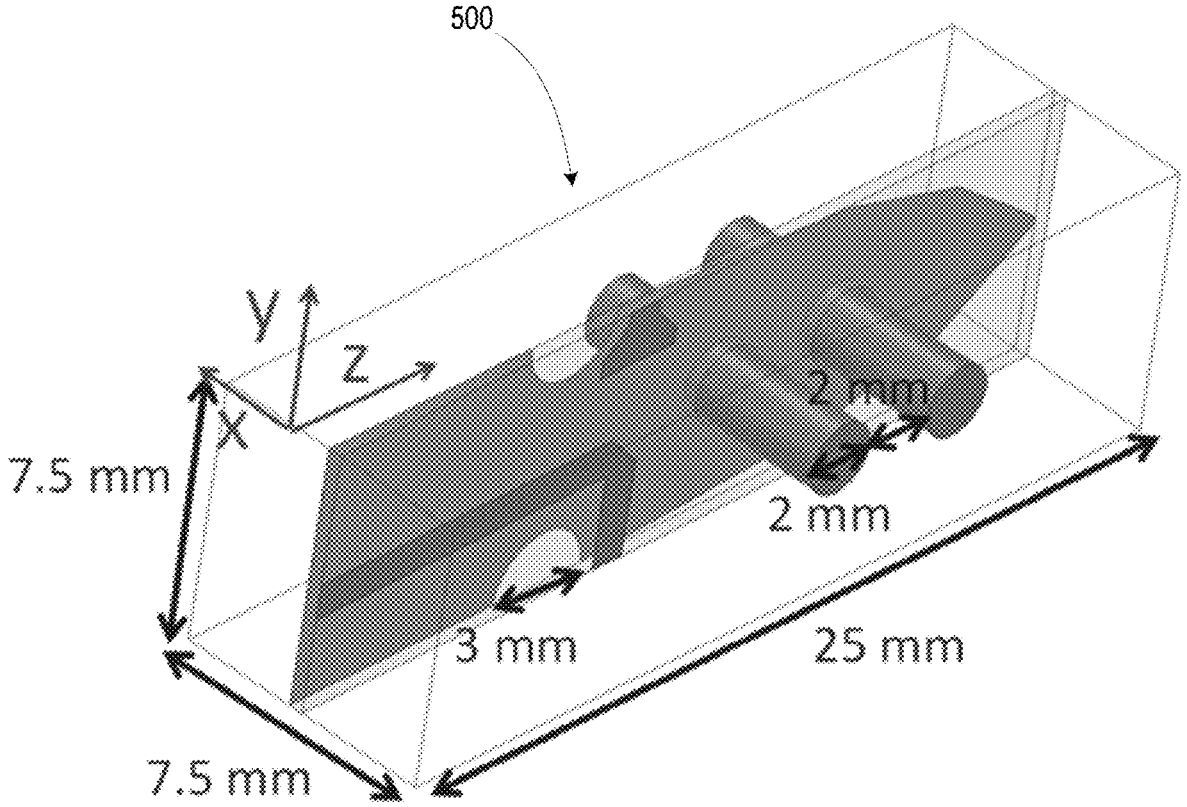
FIG. 5A is a unit cell of the Vivaldi radiating element, according to one or more embodiments.
Figure 5B:
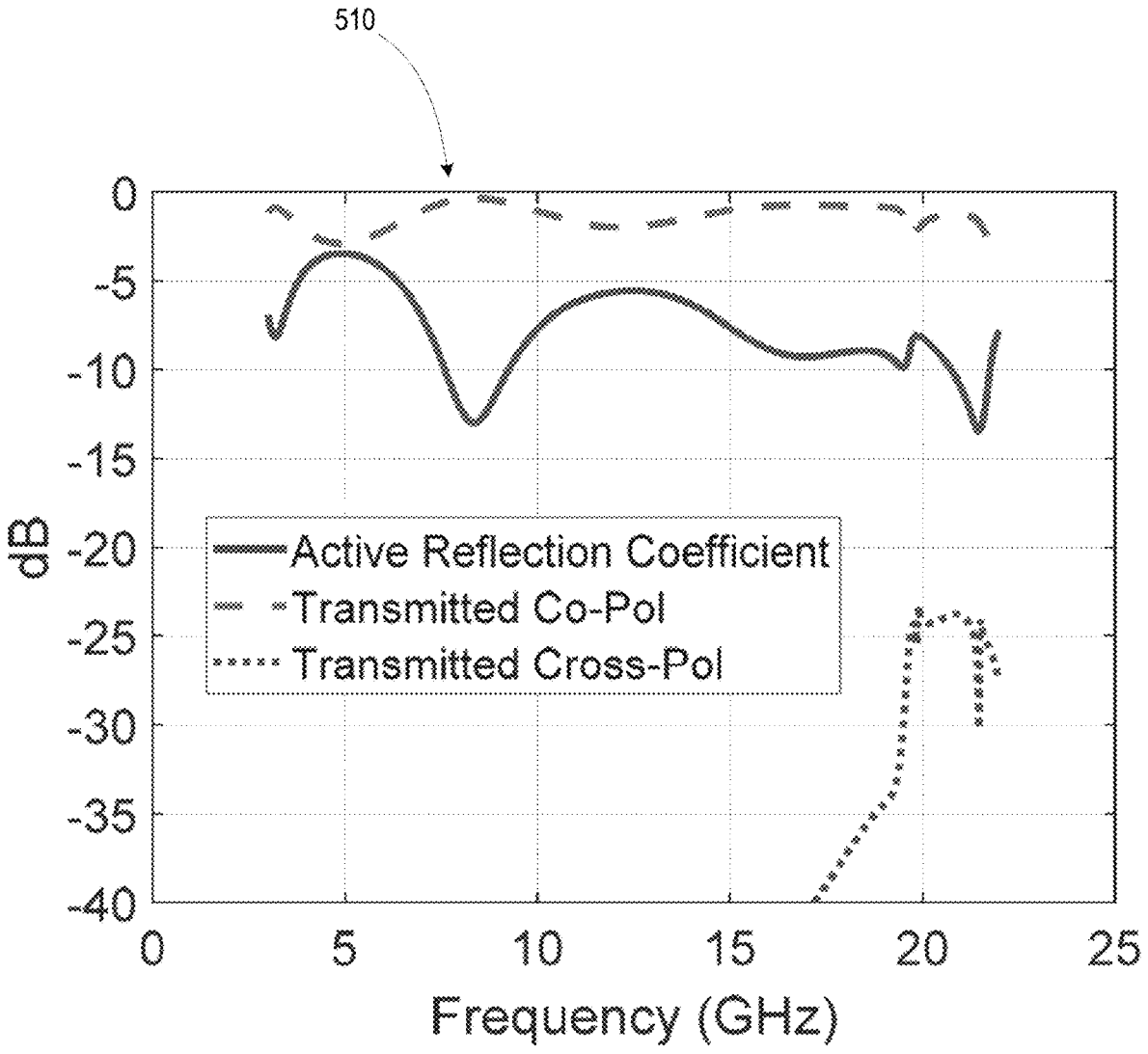
FIG. 5B is a graphical plot of an active reflection coefficient, transmitted co-polarization, and transmitted cross-polarization of the unit cell when the infinite array points towards the broadside direction, according to one or more embodiments.

Radiating Element: An UWB Vivaldi antenna array is chosen since Vivaldi radiators are notoriously simple to design and integrate onto a PCB [11]. The element spacing is 7.5 mm, which corresponds to A/2 at 20 GHz, at which point unwanted resonances in the active reflection coefficient typically appear in wideband arrays with tight element coupling. Therefore, the maximum operating frequency here is 19 GHz, which corresponds to element spacing that is just below A/2. A myriad of other UWB antennas could also have been chosen, as there exists vast literature on this topic [12]. FIG. 5A depicts a unit cell 500 of the Vivaldi radiating element. FIG. 5B depicts a graphical plot 510 of an active reflection coefficient, transmitted co-polarization, and transmitted cross-polarization of the unit cell when the infinite array points towards the broadside direction. The Vivaldi antennas are designed within an infinitely periodic geometry as shown in FIG. 5A. A 50 ohm microstrip input line feeds a slot line with a 0.14 mm gap at the feed. The slot line is exponentially tapered over a 15 mm longitudinal distance to provide an impedance match to the wave impedance of free space (376 ohms). The 2 parallel, x-directed metallic rods with 2 mm diameters suppress unwanted cross-polarized radiation from the microstrip feed line. The simulated antenna performance when the infinite array points toward the broadside direction is shown in FIG. 5B. The active reflection coefficient is less than −3 dB from 2.7 GHz to 19 GHz. The maximum mismatch loss within the operating band of 6 GHz-19 GHz is 2 dB at 12 GHz. The antennas have a relatively high mismatch loss compared to state-of-the art antenna arrays. Minimal time was spent optimizing the mismatch loss since the array has a poor radiation efficiency and is intended to be used in applications where low efficiencies are acceptable.

Figure 6:
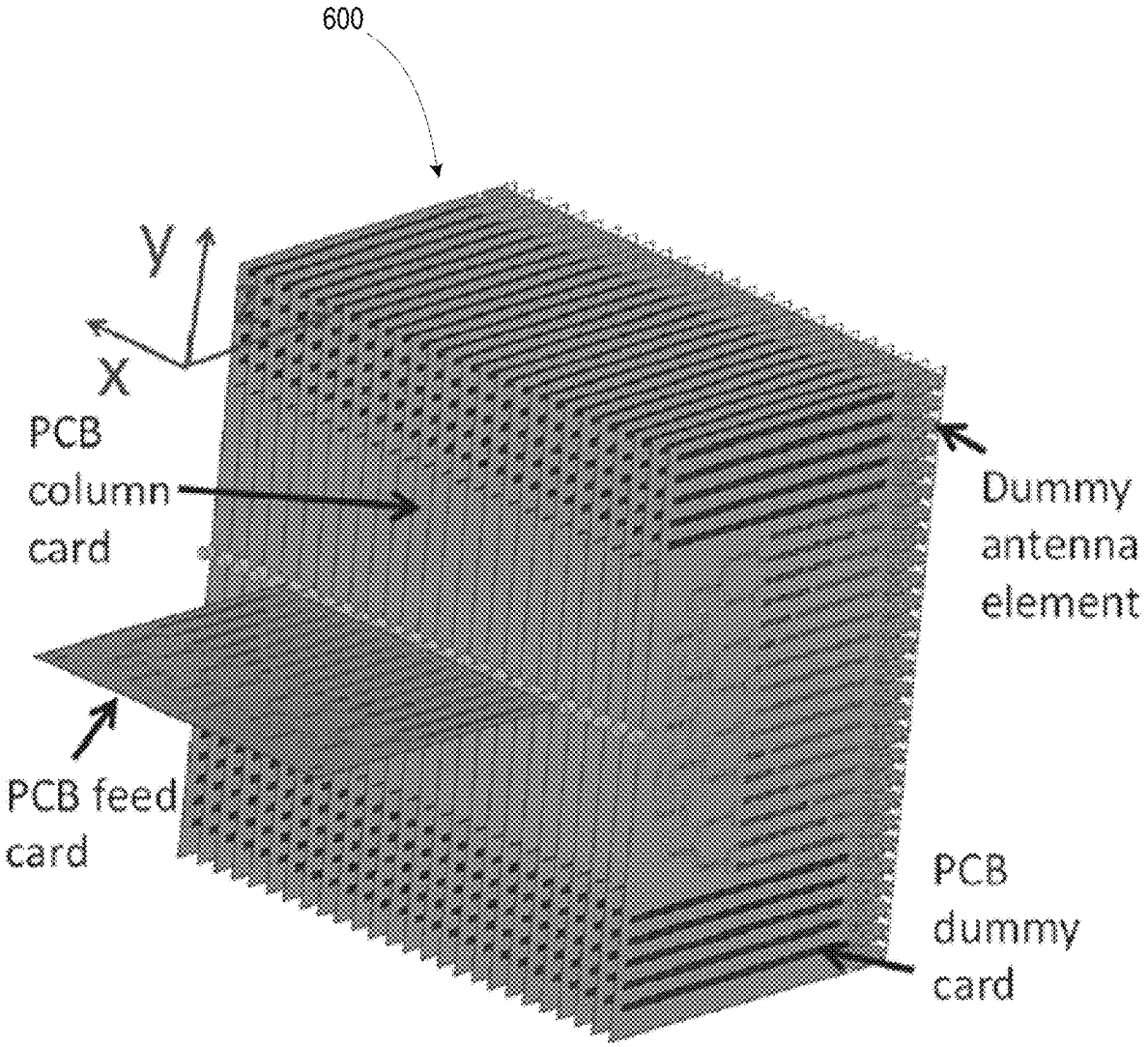
FIG. 6 is an antenna array with five (5) dummy elements on each side to minimize edge effects, according to one or more embodiments.

Overall Design: A 16×16 element array is designed to have a $1/e^2$ beamwidth of 30°. Given this aperture size, the minimum operating frequency is 6.5 GHz in accordance with (6). Each column card consists of a 1:16 corporate power divider that feeds the variable loss transmissions lines. The transmission lines are then connected to UWB Vivaldi antenna radiators. These PCB column cards are connected to a PCB feed card that contains an identical 1:16 power divider and lossy transmission lines. This ensures the 64 radiating elements have a radially symmetric excitation in accordance with (3). The corporate power dividers employ 3-stage Wilkinson power dividers for good impedance match and isolation. The PCBs are connected together using end-launch SMP connectors. FIG. 6 is an antenna array with five (5) dummy elements on each side of the array to minimize edge effects. This ensures the embedded element patterns of the Vivaldi radiators are close to that of an infinite array.

The lossy line lengths at the edges of each card are shortened to increase the number of parts that can fit on a PCB panel, which reduces cost. Simulations suggest that this minimally impacts performance. Furthermore, 1 mm gaps in the resistive ink are placed every 5 mm along each lossy line to improve the reliability of the screen printing, fabrication process. The gaps in the resistive sheets also do not have a significant impact on performance.

Figure 7A:
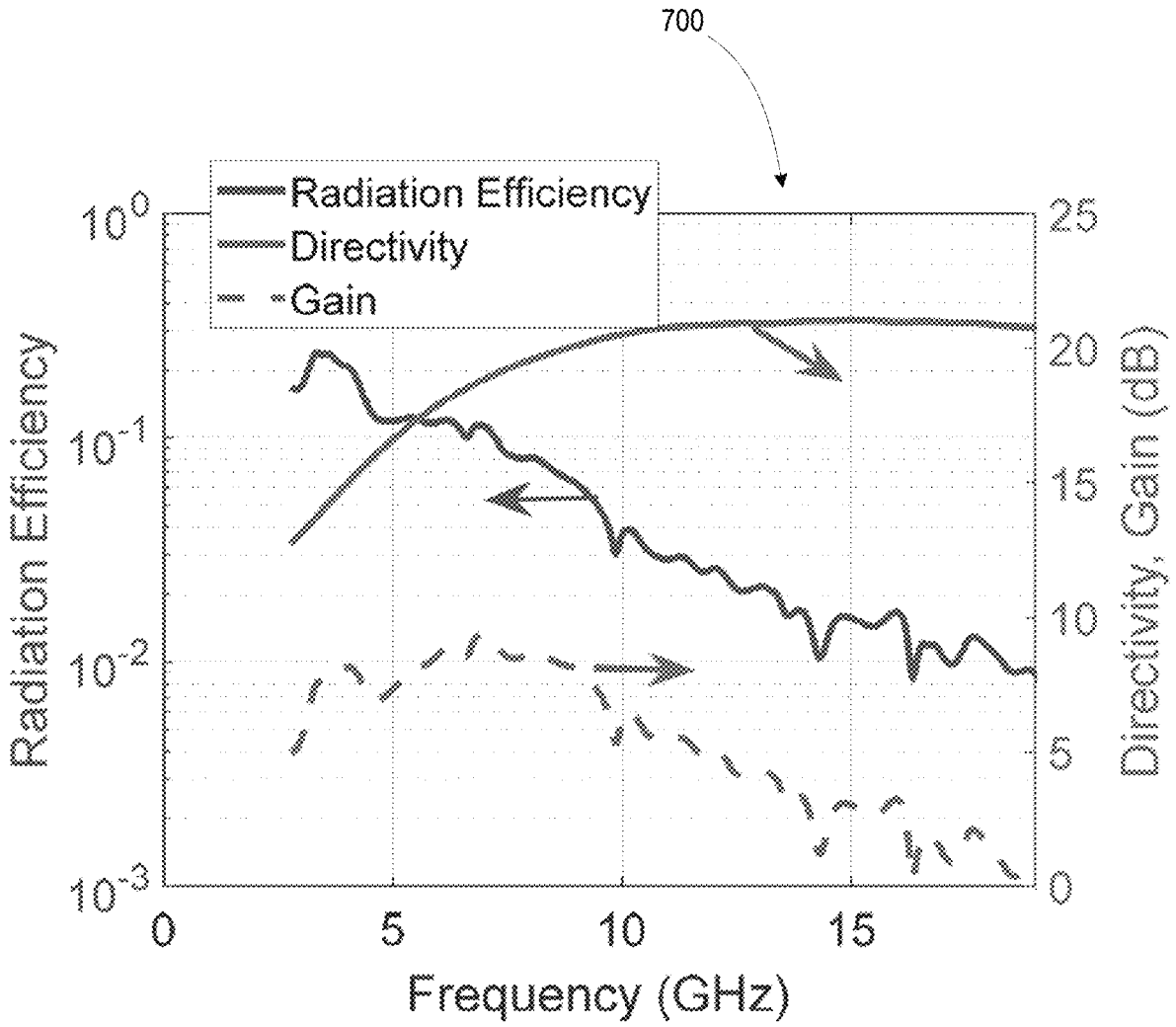
FIG. 7A is a graphical plot of calculated directivity (right axis) and radiation efficiency (left axis) versus frequency, according to one or more embodiments.
Figure 7B:
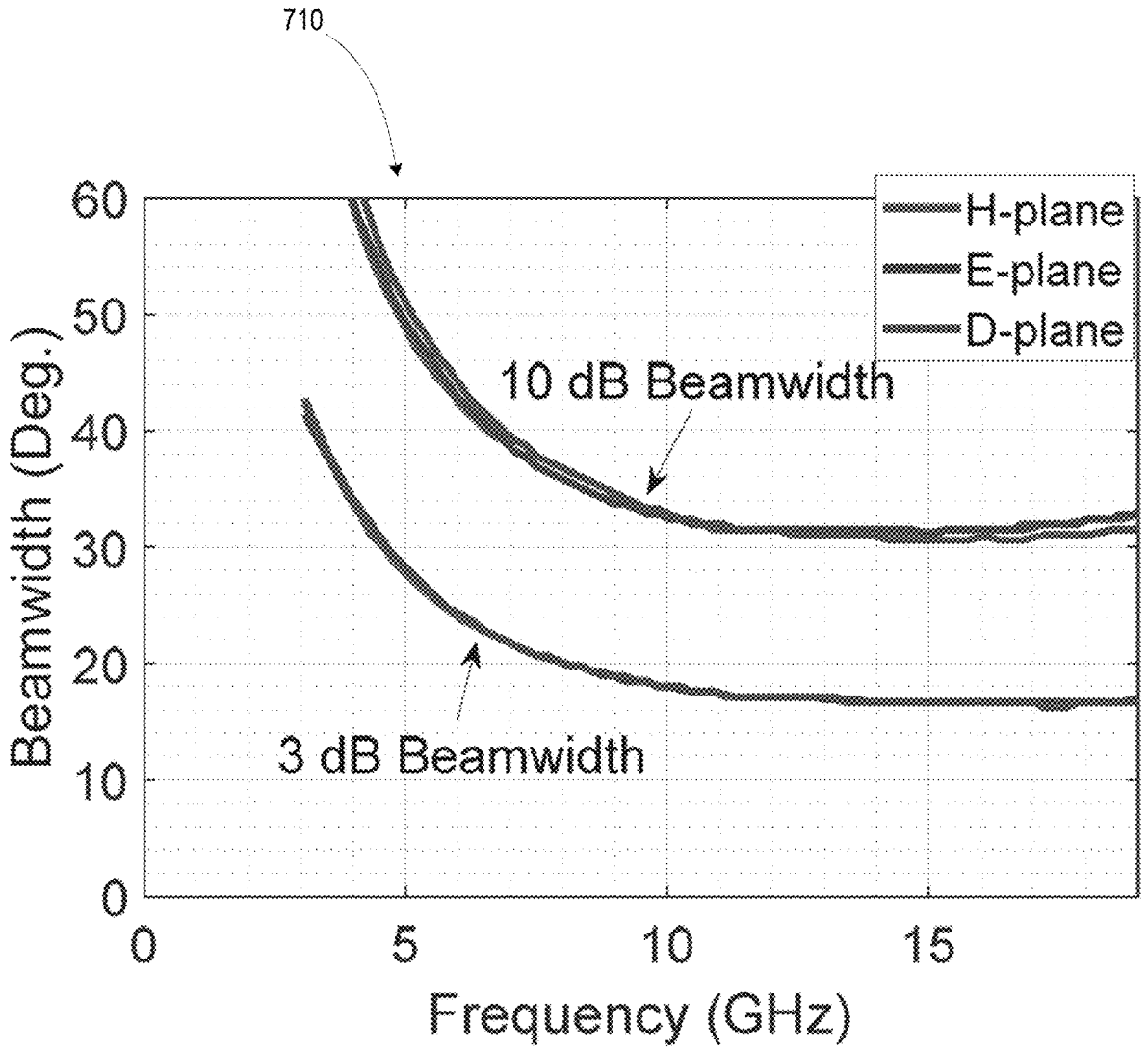
FIG. 7B is a graphical plot of calculated full beamwidth versus frequency, according to one or more embodiments.
Figure 8A:
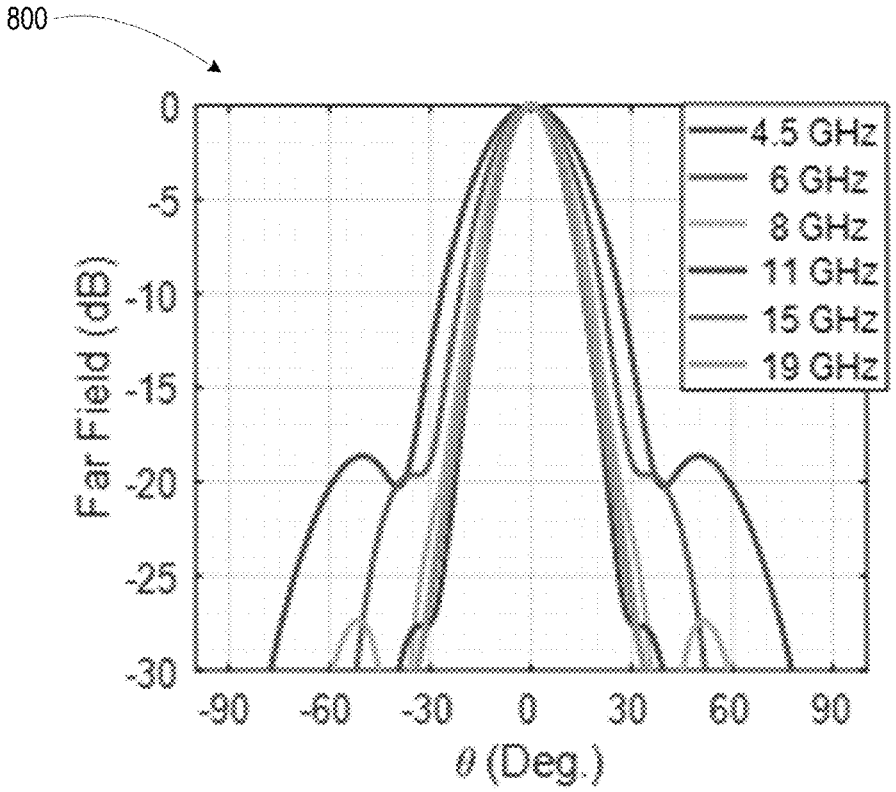
FIG. 8A is a graphical plot of calculated co-polarized radiation patterns in the H-plane, according to one or more embodiments.
Figure 8B:
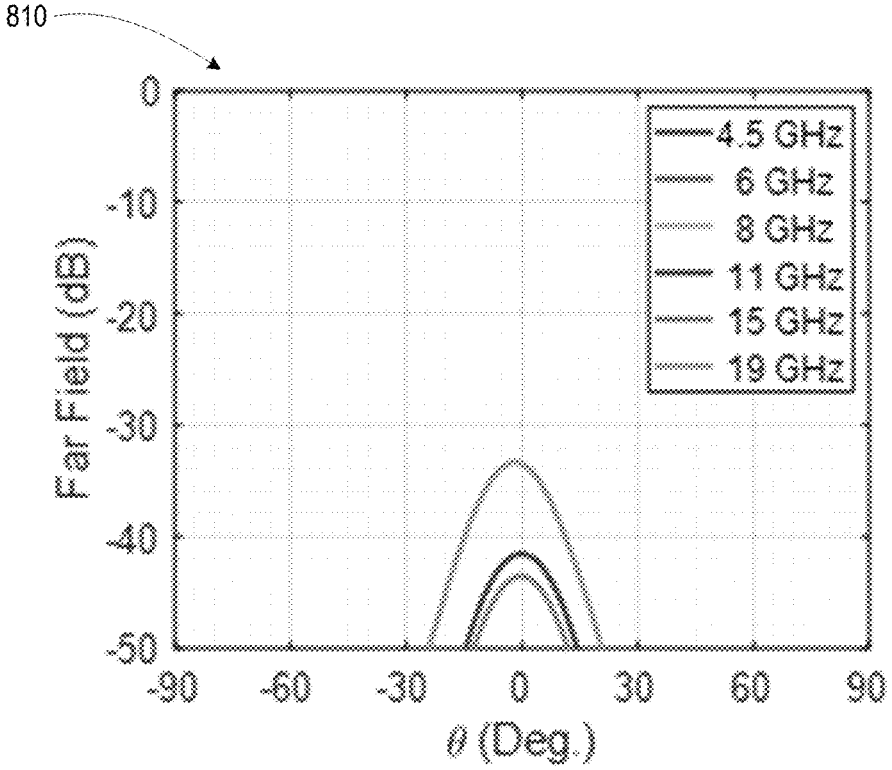
FIG. 8B is a graphical plot of calculated cross polarized radiation patterns in the H-plane, according to one or more embodiments.
Figure 8C:
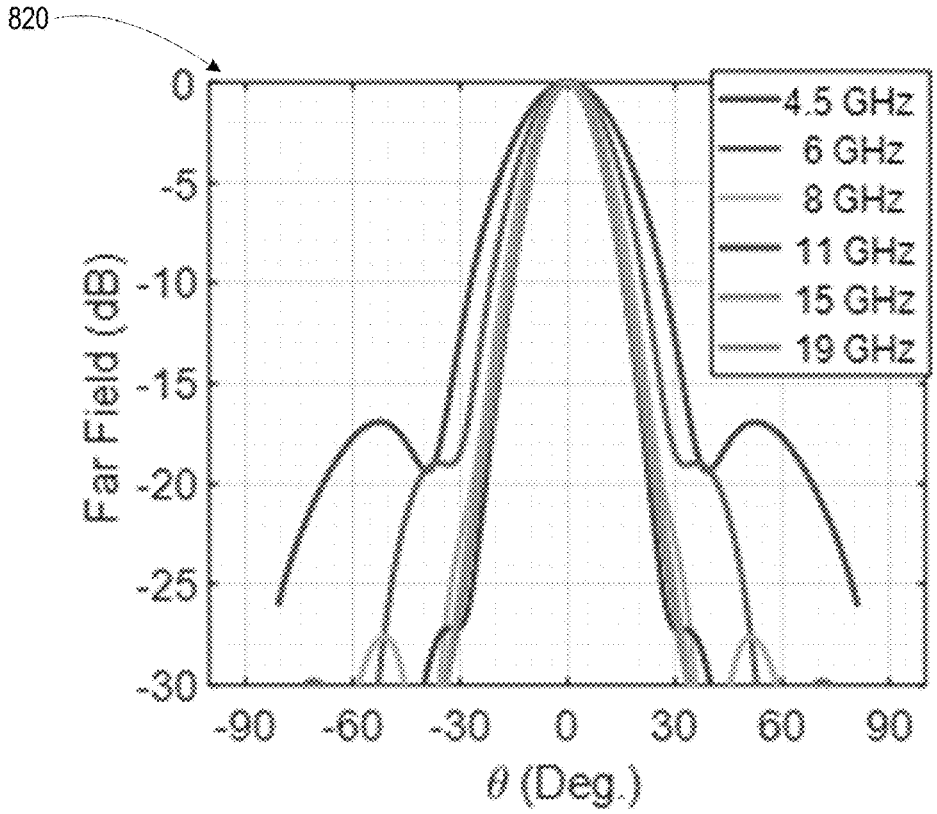
FIG. 8C is a graphical plot of calculated co-polarized radiation patterns in the E-plane, according to one or more embodiments.
Figure 8D:
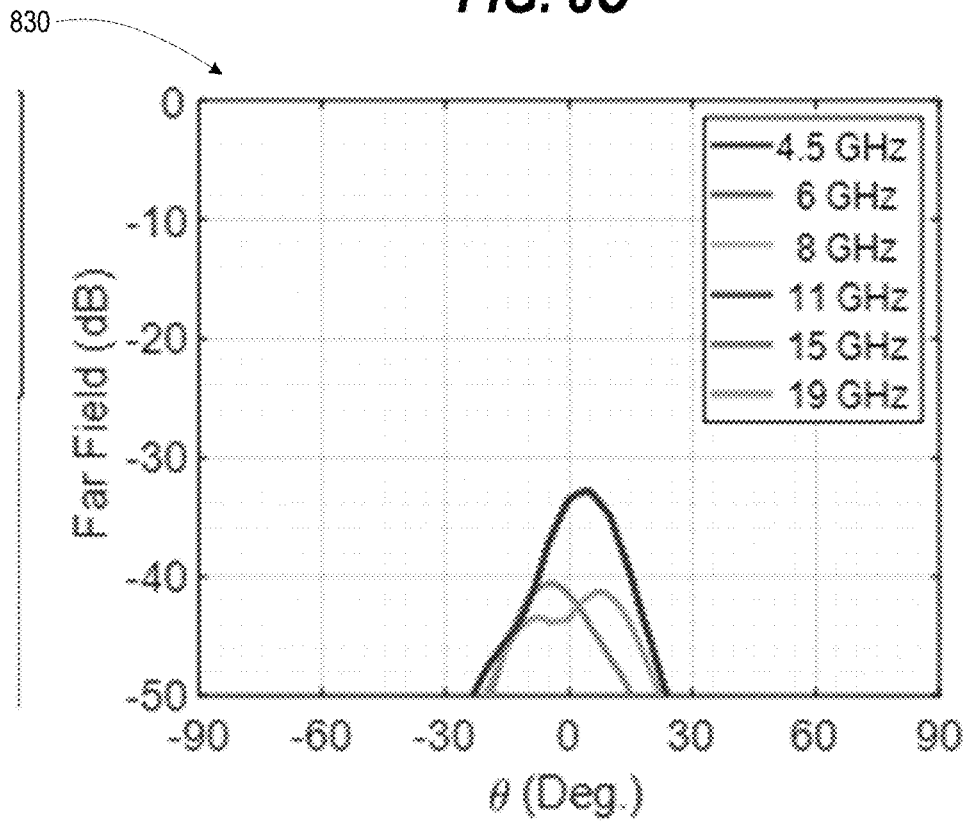
FIG. 8D is a graphical plot of calculated cross polarized radiation patterns in the E-plane, according to one or more embodiments.
Figure 8E:
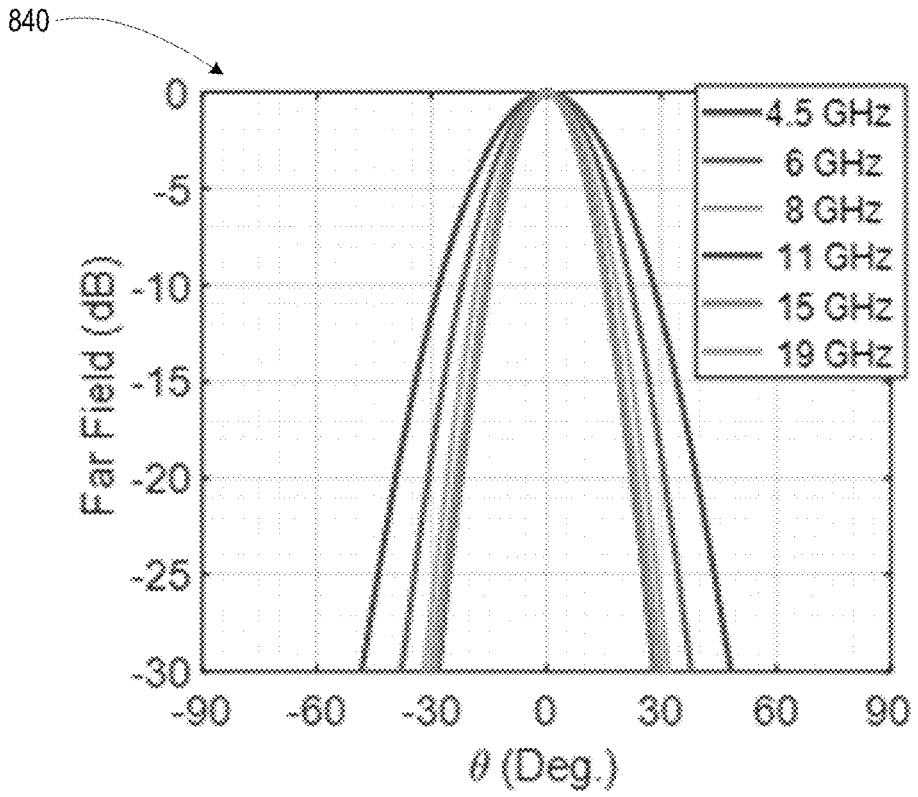
FIG. 8E is a graphical plot of calculated co-polarized radiation patterns in the D-plane ($\phi$=45°), according to one or more embodiments.
Figure 8F:
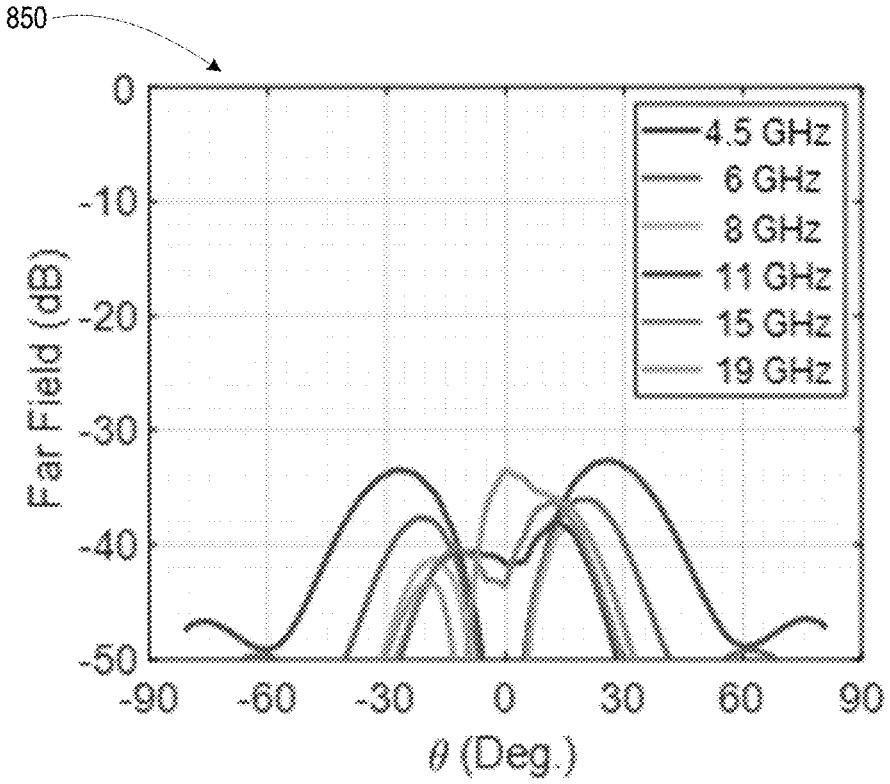
FIG. 8F is a graphical plot of calculated cross polarized radiation patterns in the D-plane ($\phi$=45°), according to one or more embodiments.

The entire array is too large to simulate with a full-wave solver using the available computational resources. Therefore, the performance of the array is estimated by multiplying the transmission coefficients of the various components (corporate power dividers, lossy transmission lines, low loss transmission lines, Vivaldi antenna elements). This assumes there is a good impedance match between each section up to the Vivaldi antennas. The radiation patterns assume the Vivaldi antennas have an element pattern identical to that of an infinite array. FIG. 7A depicts a graphical plot 700 of calculated directivity (right axis) and radiation efficiency (left axis) versus frequency. FIG. 7B is a graphical plot 710 of calculated full beamwidth versus frequency. The radiation efficiency and directivity versus frequency are shown in FIG. 7A. As expected the radiation efficiency reduces as the frequency is increased. The ripple in the radiation efficiency is primarily due to mismatch loss of the Vivaldi antennas and the insertion loss of 1:16 corporate power dividers. The 3 dB and 10 dB full beamwidths are shown in FIG. 7B. The radiation patterns in the E, H, and diagonal planes ($\phi$=45°) are shown in FIGS. 8A-8F. FIG. 8A depicts a graphical plot 800 of calculated co-polarized radiation patterns in the H-plane. FIG. 8B depicts a graphical plot 810 of calculated cross polarized radiation patterns in the H-plane. FIG. 8C depicts a graphical plot 820 of calculated co-polarized radiation patterns in the E-plane. FIG. 8D depicts a graphical plot 830 of calculated cross polarized radiation patterns in the E-plane. FIG. 8E depicts a graphical plot 840 of calculated co-polarized radiation patterns in the D-plane ($\phi$=45°). FIG. 8F depicts a graphical plot 850 of calculated cross polarized radiation patterns in the D-plane ($\phi$=45°). The patterns are nearly identical from 6.5 GHz to 19 GHz, which agrees well with theory. The patterns have a cross-polarization below 30 dB in all three planes.

Figure 9A:
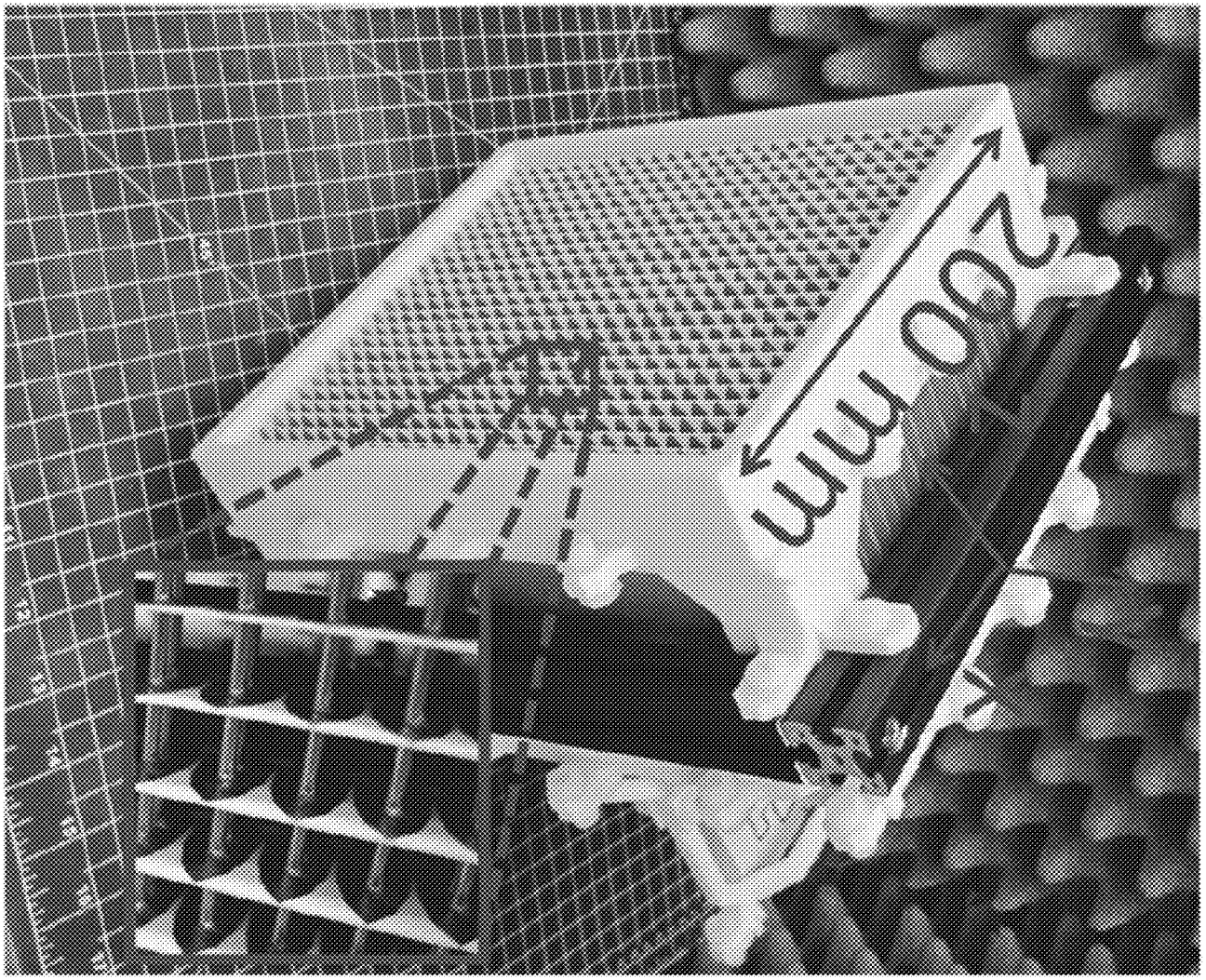
FIG. 9A is a front three-dimensional view of a fabricated prototype with an inset zoomed-in view of the wideband rod-loaded Vivaldi radiators located at the antenna aperture, according to one or more embodiments.
Figure 9B:
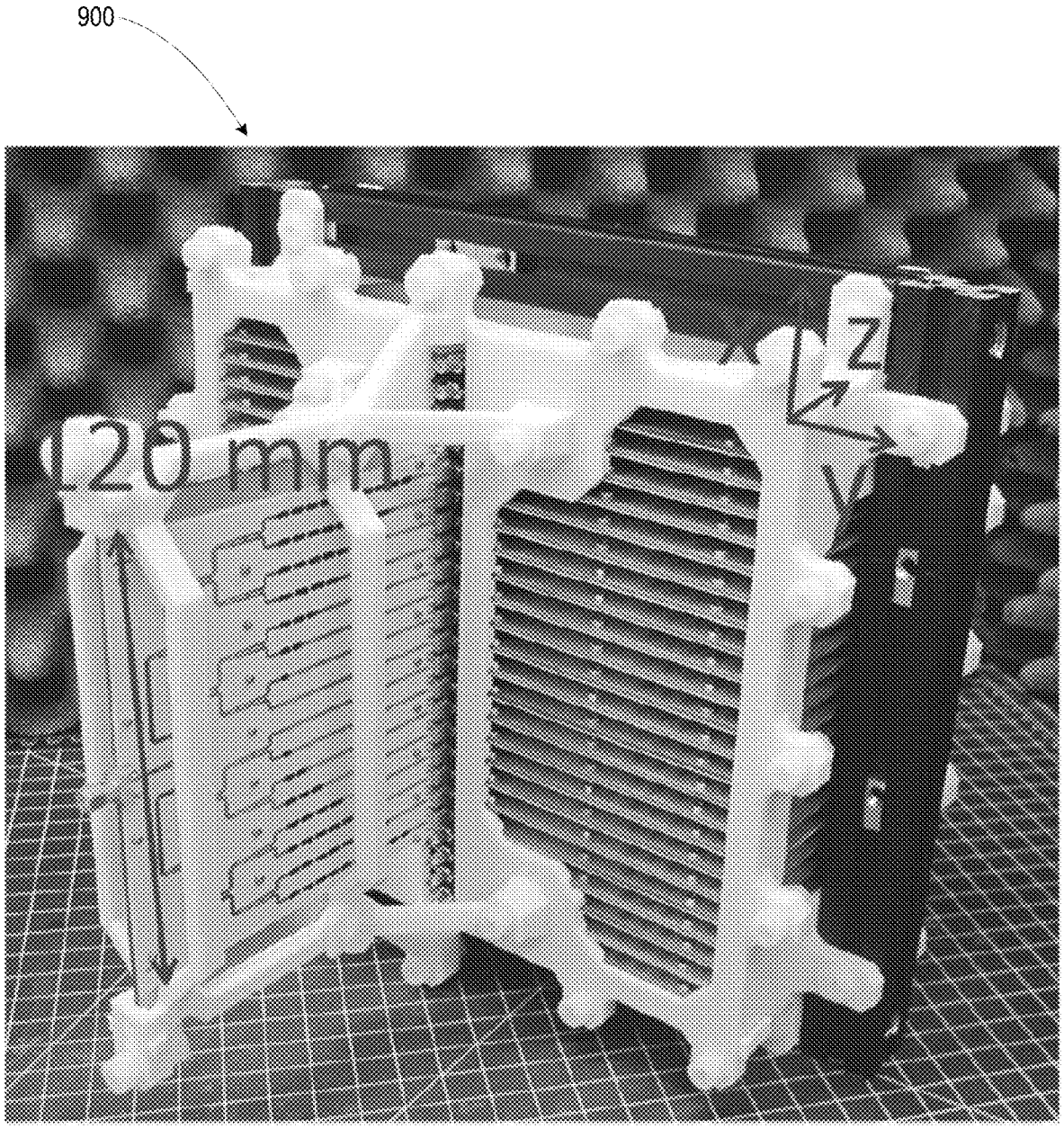
FIG. 9B is a back three-dimensional view of the fabricated prototype of FIG. 9A, according to one or more embodiments.

Measurements: The prototype antenna is fabricated and measured. The printed circuit boards are constructed using standard double sided photolithography techniques on 0.4 mm thick Rogers 4003 boards. The resistive paste is screen printed onto the PCB. FIG. 9A depicts a fabricated prototype 900 with an inset zoomed-in view of the wideband rod-loaded Vivaldi radiators located at the antenna aperture. FIG. 9B depicts the array at the back of the fabricated prototype 900. The top of the feed card can be clearly seen which includes the black resistive paste along the lossy transmission lines. A white 3D printed casing properly aligns all of the PCB cards. This 3D printed casing is screwed to a black slotted metal frame around the outside to simplify mounting to external structures.

Figure 10A:
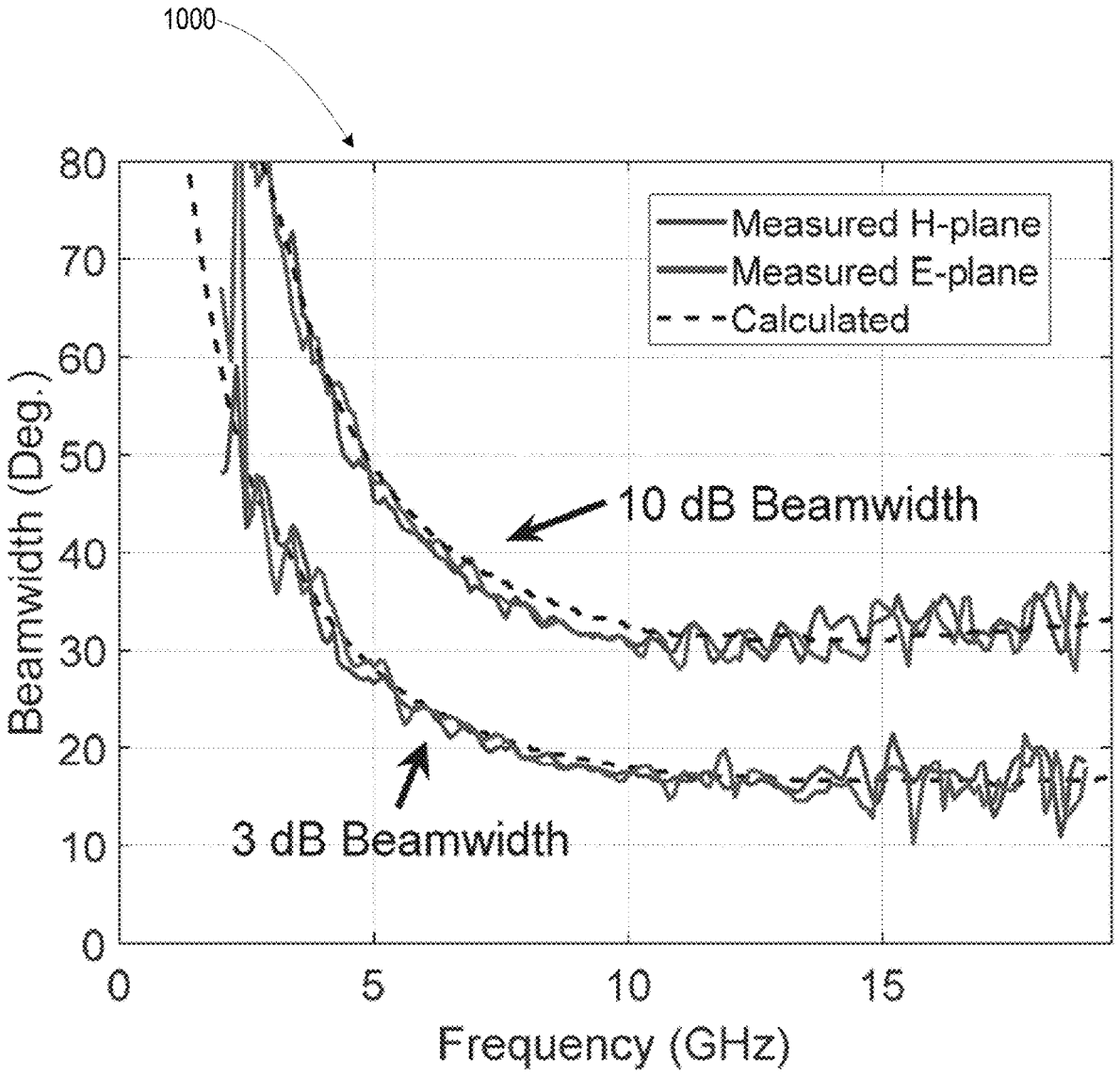
FIG. 10A is a graphical plot of measured and predicted 10 dB and 3 dB beamwidths, according to one or more embodiments.
Figure 10B:
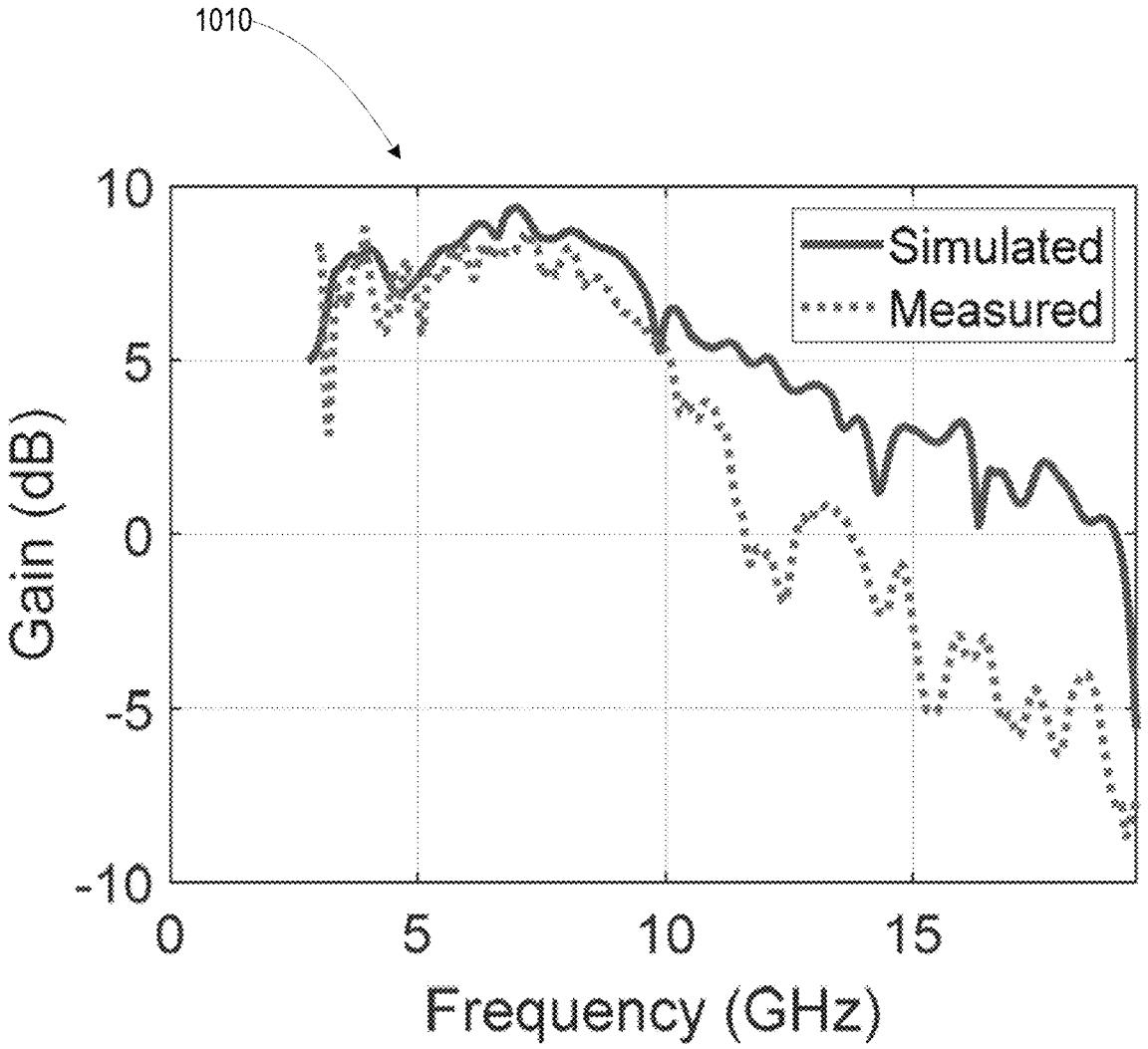
FIG. 10B is a graphical plot of measured and simulated gain in the broadside direction versus frequency, according to one or more embodiments.
Figure 11A:
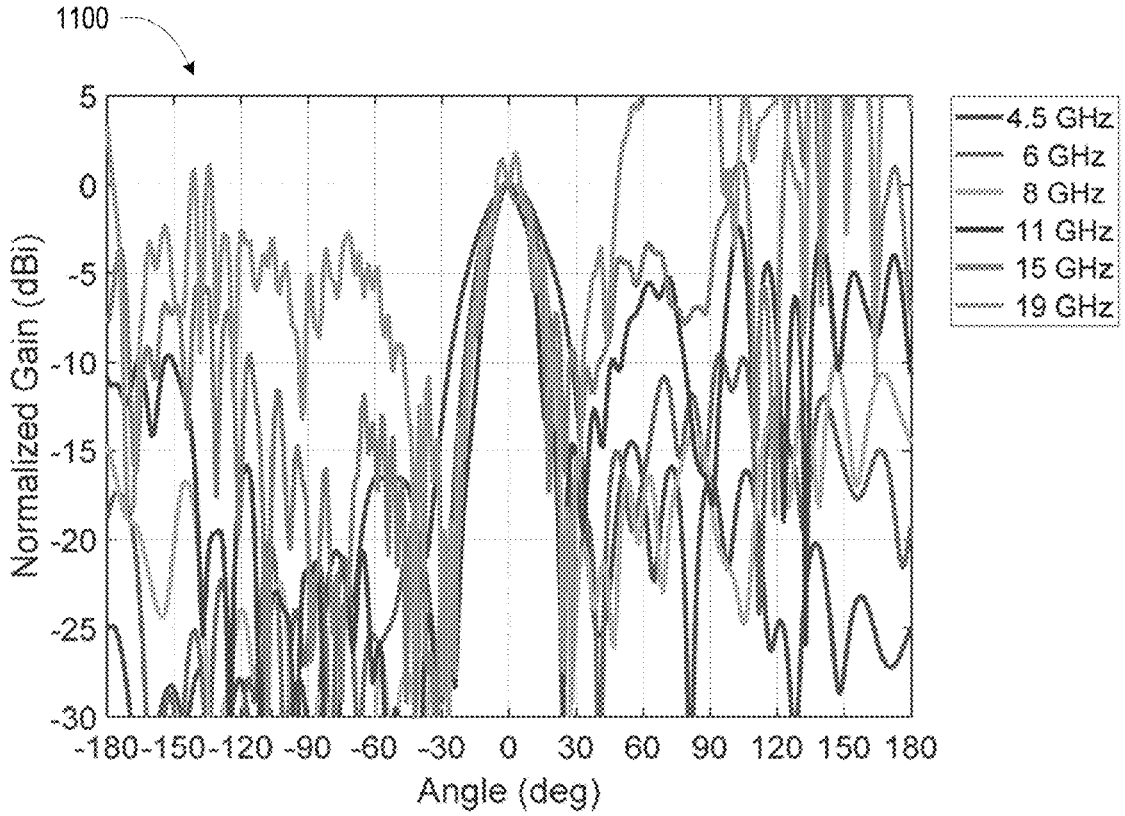
FIG. 11A is a graphical plot of measured radiation patterns at various frequencies in the E-plane, according to one or more embodiments.
Figure 11B:
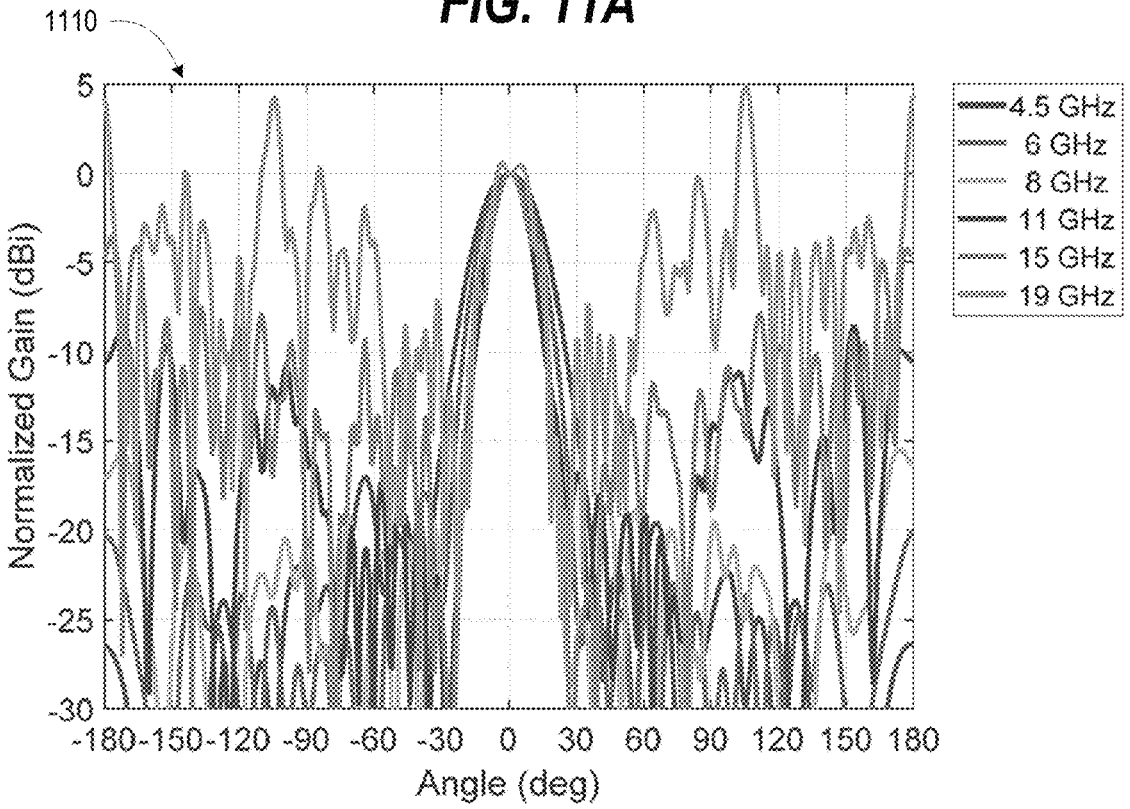
FIG. 11B is a graphical plot of measured radiation patterns at various frequencies in the H-plane, according to one or more embodiments.

FIG. 10A depicts a graphical plot 1000 of measured and predicted 10 dB and 3 dB beamwidths. FIG. 10B depicts a graphical plot 1010 of measured and simulated gain in the broadside direction versus frequency. There is generally good agreement between measurements and calculations, which validates the underlying theory. However, there is a significant amount of ripple in the measured data. FIG. 11A is a graphical plot 1100 of measured radiation patterns at various frequencies in the E-plane. FIG. 11B is a graphical plot 1110 of measured radiation patterns at various frequencies in the H-plane. The first observation is the extremely high sidelobes, especially at the higher operating frequencies. Unfortunately, these unexpectedly high sidelobes make the current antenna unusable from a practical standpoint.

Figure 12:
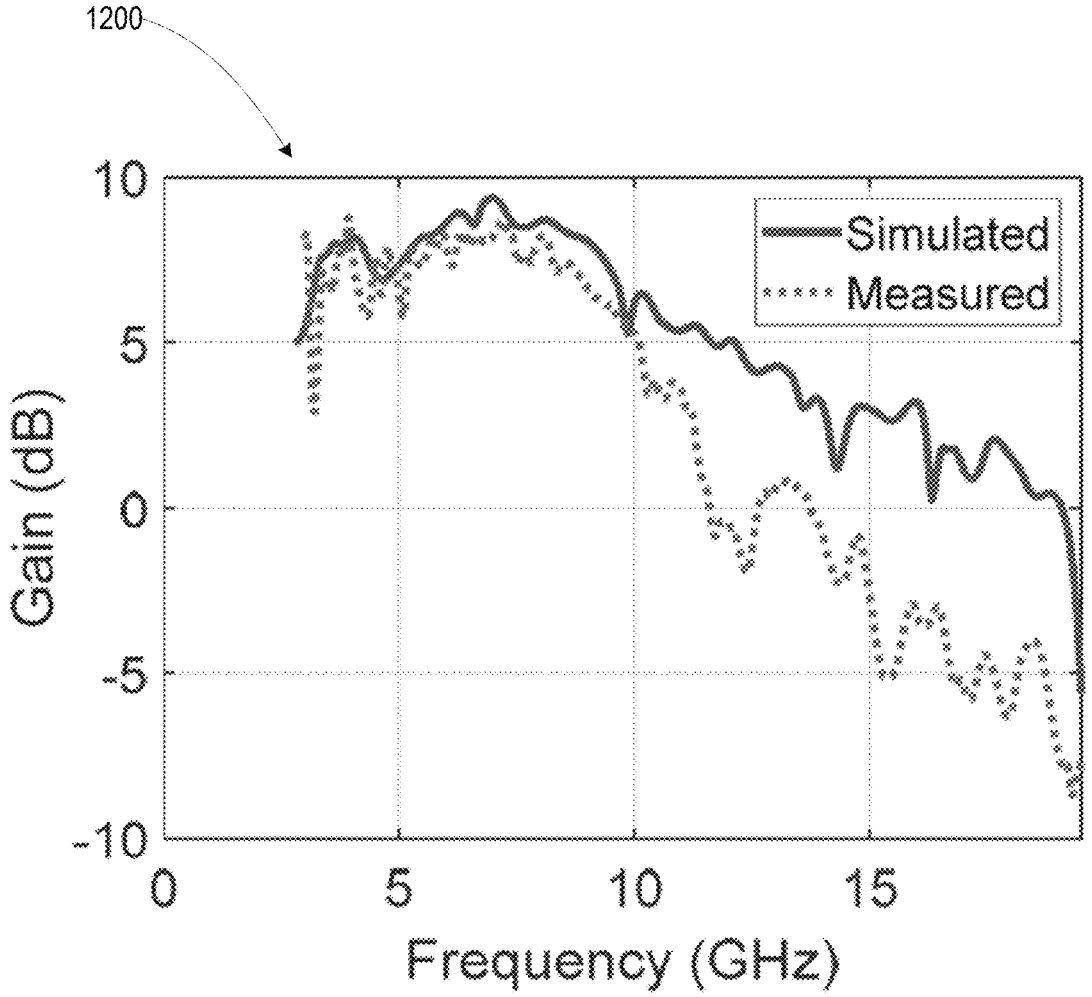
FIG. 12 is a graphical plot of simulated fraction of incident power radiated from the aperture and corporate power dividers, according to one or more embodiments.

The theorized source of this unwanted radiation is from the corporate power divider feeding the lossy microstrip lines. It is well known that microstrip lines have radiative losses when they are bent. Nevertheless, microstrip traces are often used because they are easy to fabricate and are low cost. The radiation from microstrip traces is typically low compared to radiation from the aperture, and therefore this radiation does not have a significant effect on the pattern for most antennas. However, the particularly lossy antenna reported here has a low radiation efficiency. FIG. 12 depicts a graphical plot 1200 of simulated fraction of incident power radiated from the aperture and corporate power dividers. The corporate power dividers actually radiate more power than the aperture over much of the designed bandwidth. The measured sidelobes are particularly high at 8>90° in the E-plane. This is the region seen by the corporate power divider on the input feed card, which provides additional evidence that power divider radiation is the source of high sidelobes. As a point of reference, the normal direction of the input feed card is 8=90° in the E-plane. Unfortunately, radiation from the corporate power divider was not properly considered before the array was fabricated, which led to this poor performance. In the future, a stripline geometry should be used to eliminate unwanted radiation from the corporate power divider. It is expected that a stripline based designed would have measured sidelobes much closer to simulation. Regrettably, time and budgetary constraints made it unfeasible to build a second version of the array using a stripline feed network.

SUMMARY: A new method of designing UWB feed antennas with uniform beamwidths is reported. Resistively loaded transmission lines are systematically designed to generate the necessary frequency dependent loss for realizing a Gaussian amplitude taper across an arbitrarily large frequency range. A particularly nice feature of this approach is once the transmission line geometry is designed, the radiated beamwidth can be easily customized for a given application without requiring additional full-wave simulations. Furthermore, the cross-polarized radiation is inherently low (below 30 dB in simulation). The limitations of this approach are the resistively loaded transmission lines require long lengths for UWB antennas, which leads to a bulky antenna. In addition the radiation efficiency is low, especially for UWB designs. Measured beamwidths agree well with simulations to provide validation for the reported theory. However, the fabricated antenna has significant radiation from the microstrip traces in the feed network. This radiation leads to large ripple in the radiation patterns and high sidelobes. In the future, a stripline based topology should eliminate unwanted radiation from the feed network so that the measured radiation patterns agree more closely with simulation.

REFERENCES

The following publications cited above are hereby incorporated by reference in their entirety:

[1] P.-S. Kildal, "Artificially soft and hard surfaces in electromagnetics," IEEE Trans. on Antennas and Propagation, vol. 38, no. 10, p. 1537, 1990.

[2] P. F. Goldsmith, "Quasi-optical techniques," Proceedings of the IEEE, vol. 80, pp. 1729-1747, 1992.

[3] L.-C. T. Chang and W. D. Burnside, "An ultrawide-bandwidth tapered resistive TEM horn antenna," IEEE Trans. on Antennas and Propagation, vol. 48, no. 12, p. 1848, 2000.

[4] A. Akgiray, S. Weinreb, W. A. Imbraile and C. Beaudoin, "Circular quadruple-ridged flared horn achieving near-constant beamwidth over multioctave bandwidth: design and measurements," IEEE Trans. on Antennas and Propagation, vol. 61, no. 3, p. 1099, 2013.

[5] R. Olsson, P.-S. Kildal and S. Weinreb, "The Eleven antenna: a compact low-profile decade bandwidth dual polarized feed for reflector antennas," IEEE Transactions on Antennas and Propagation, vol. 54, no. 2, p. 368, 2006.

[6] J. Yang, X. Chen, N. Wadefalk and P.-S. Kildal, "Design and realization of a linearly polarized Eleven feed for 1-10 GHz," IEEE Antennas and Wireless Propagation Letters, vol. 8, p. 64, 2009.

[7] R. Gawande and R. Bradley, "Towards an ultra wideband low noise active sinuous feed for next generation radio telescopes," IEEE Transactions on Antennas and Propagation, vol. 59, no. 6, p. 1945, 2011.

[8] S. Bruni, A. Neto and F. Marliani, "The ultrawideband leaky lens antenna," IEEE Transactions on Antennas and Propagation, vol. 55, no. 10, p. 2642, 2007.

[9] M. V. Ivashina, O. Iupikov, R. Maaskant, W. A. v. Cappellen and T. Oosterloo, "An optimal beamforming strategy for wide-field surveys with phased-array-fed reflector antennas," IEEE Transactions on Antennas and Propagation, vol. 59, no. 6, p. 1864, 2011.

[10] D. M. Pozar, Microwave Engineering, John Wiley & Sons, 2009.

[11] D. H. Schaubert, S. Kasturi, A. O. Boryssenko and W. M. Elsallal, "Vivaldi antenna arrays for wide bandwidth and electronic scanning," in European Conference on Antennas and Propagation, Edinburgh, UK, 2007.

[12]R. Kindt and J. Logan, "Benchmarking ultrawideband phased antenna arrays: striving for clearer and more informative reporting practices," IEEE Antennas and Propagation Magazine, vol. 60, no. 3, p. 34, 2018.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

In the preceding detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. An ultra wide band (UWB) antenna comprising:

an array of antenna elements spaced from a central axis;

a network of lossy feedlines respectively communicatively coupled to the array of antenna elements, each lossy feedline periodically loaded with a resistance that is capacitively coupled to ground, respective lengths of each lossy feedline is selected to increase with an increase in distance from the central axis.

2. The UWB antenna of claim 1 wherein the network of resistively-loaded feedlines have respective resistances selected to correspond to a Gaussian amplitude taper for low sidelobes.

3. The UWB antenna of claim 1 wherein the network of resistively-loaded feedlines comprise a resistive ink/film printed onto a signal trace of a selected one of a: (i) microstrip; and (ii) a stripline transmission line.

4. The UWB antenna of claim 1, further comprising a corporate power divider that is communicatively coupled to the network of resistively-loaded feedlines.

5. The UWB antenna of claim 1, wherein the antenna elements comprise Vivaldi antenna elements.

* * * * *